US010811753B2

(12) United States Patent
Nakajima et al.

(10) Patent No.: US 10,811,753 B2
(45) Date of Patent: Oct. 20, 2020

(54) HOLLOW-WAVEGUIDE-TO-PLANAR-WAVEGUIDE TRANSITION INCLUDING A COUPLING CONDUCTOR HAVING ONE OR MORE CONDUCTORS BRANCHING THEREFROM

(71) Applicant: Mitsubishi Electric Corporation, Tokyo (JP)

(72) Inventors: Hiromasa Nakajima, Tokyo (JP); Akimichi Hirota, Tokyo (JP); Naofumi Yoneda, Tokyo (JP); Takeshi Oshima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/098,062

(22) PCT Filed: Jul. 5, 2016

(86) PCT No.: PCT/JP2016/069891
§ 371 (c)(1),
(2) Date: Oct. 31, 2018

(87) PCT Pub. No.: WO2018/008086
PCT Pub. Date: Jan. 11, 2018

(65) Prior Publication Data
US 2019/0148808 A1 May 16, 2019

(51) Int. Cl.
*H01P 5/107* (2006.01)
*H01P 1/02* (2006.01)
(Continued)

(52) U.S. Cl.
CPC ..... *H01P 5/107* (2013.01); *H01P 1/02* (2013.01); *H01P 3/081* (2013.01); *H01P 3/121* (2013.01); *H01P 5/08* (2013.01)

(58) Field of Classification Search
CPC ..... H01P 5/107
(Continued)

(56) References Cited

U.S. PATENT DOCUMENTS 6,639,487 B1 * 10/2003 Salmela et al. ..... H01P 5/028 333/238
8,723,616 B2 * 5/2014 Hirota et al. ..... H01P 5/107 333/26
(Continued)

FOREIGN PATENT DOCUMENTS

CN 104485500 A 4/2015
EP 1 986 265 A1 10/2008
(Continued)

OTHER PUBLICATIONS

Office Action dated Nov. 29, 2019 in corresponding German Application No. 11 2016 006 883.2.
(Continued)

*Primary Examiner* — Benny T Lee
(74) *Attorney, Agent, or Firm* — Birch, Stewart, Kolasch & Birch, LLP

(57) ABSTRACT

A hollow-waveguide-to-planar-waveguide transition circuit includes: a dielectric substrate; strip conductors formed on a first main surface of the dielectric substrate; a ground conductor formed on a second main surface of the dielectric substrate, facing the strip conductors in the thickness direction; a slot formed in the ground conductor; a coupling conductor formed at a position to be electrically coupled with the strip conductors on the first main surface; and branch conductor lines formed on the first main surface. Each of the branch conductor lines includes a base portion branching from the coupling conductor and a tip portion that is electrically open.

16 Claims, 15 Drawing Sheets

(51) Int. Cl.
*H01P 3/08* (2006.01)
*H01P 3/12* (2006.01)
*H01P 5/08* (2006.01)

(58) Field of Classification Search
USPC ..... 333/26
See application file for complete search history.

(56) References Cited

U.S. PATENT DOCUMENTS

2006/0255875 A1 11/2006 Lio
2008/0266196 A1* 10/2008 Shi ..... H01P 5/107 343/772
2010/0038775 A1* 2/2010 Camiade et al. ..... H01P 5/107 257/728
2011/0037530 A1* 2/2011 Mangalahgari et al. ..... H01P 5/107 333/26
2011/0267153 A1 11/2011 Hirota et al.
2012/0112857 A1* 5/2012 Lim et al. ..... H01P 1/2039 333/238
2013/0027259 A1 1/2013 Fujita et al.

FOREIGN PATENT DOCUMENTS

JP 2002-198742 A 7/2002
JP 2010-056920 A 3/2010
JP 2013-031064 A 2/2013
JP 2015-033099 A 2/2015

OTHER PUBLICATIONS

Office Action dated Jun. 22, 2020 in corresponding Chinese Application No. 201680087210.6.

* cited by examiner

HOLLOW-WAVEGUIDE-TO-PLANAR-WAVEGUIDE TRANSITION INCLUDING A COUPLING CONDUCTOR HAVING ONE OR MORE CONDUCTORS BRANCHING THEREFROM

TECHNICAL FIELD

The present invention relates to a transition circuit for performing conversion of a transmission mode between a hollow waveguide and a planar waveguide such as a microstrip line.

BACKGROUND ART

In high-frequency transmission lines used in a high-frequency band such as a millimeter wave band or a microwave band, to couple a hollow waveguide and a planar waveguide such as a microstrip line or a coplanar line to each other, transition circuits are widely used for converting a transmission mode between the hollow waveguide and the planar waveguide. For example, Patent Literature 1 (Japanese Patent Application Publication No. 2010-56920) discloses a hollow-waveguide-to-microstrip-line transition circuit for coupling a hollow waveguide with a microstrip line.

The structure of the microstrip line disclosed in Patent Literature 1 includes: a conductor plate and a strip conductor formed on the front surface of a dielectric substrate; a ground conductor provided on the entire back surface of the dielectric substrate; and a plurality of connecting conductors provided in the dielectric substrate and connecting the conductor plate and the ground conductor to each other. The ground conductor is connected to an end portion of the rectangular waveguide, and the ground conductor includes a rectangular slot for electrically coupling with the end portion of the rectangular waveguide. In addition, the conductor plate and the ground conductor form a coplanar line structure. Further, the connecting conductors are arranged around the periphery of a shorting plane (short-circuit plane) of the end portion of the rectangular waveguide. By providing these connecting conductors, unnecessary radiation from the slot can be suppressed.

CITATION LIST

Patent Literature

Patent Literature 1: Japanese Patent Application Publication No. 2010-56920 (for example, FIGS. 1 and 2 and paragraphs [0013] to [0018], and FIGS. 12 and 13 and paragraphs [0043] to [0049])

SUMMARY OF THE INVENTION

Technical Problem

However, with the structure disclosed in Patent Literature 1, there is the disadvantage that, because the connecting conductors are necessary for suppressing unnecessary radiation, the manufacturing process of the hollow-waveguide-to-microstrip-line transition circuit becomes complicated, thereby increasing manufacturing cost.

In view of the foregoing, an object of the present invention is to provide a hollow-waveguide-to-planar-waveguide transition circuit capable of suppressing unnecessary radiation as well as reducing manufacturing cost.

Solution to the Problem

In accordance with an aspect of the present invention, there is provided a hollow-waveguide-to-planar-waveguide transition circuit for transmitting a high-frequency signal. The hollow-waveguide-to-planar-waveguide transition circuit includes: a dielectric substrate having a first main surface and a second main surface which face each other in a thickness direction of the dielectric substrate; one or more strip conductors formed on the first main surface, extending along a first in-plane direction determined in advance; a ground conductor formed on the second main surface to face the one or more strip conductors in the thickness direction; one or more slots formed in the ground conductor and extending in a second in-plane direction different from the first in-plane direction on the second main surface; a coupling conductor formed at a position to be electrically coupled with the one or more strip conductors on the first main surface, and disposed at a position facing the one or more slots in the thickness direction; and one or more branch conductor lines branching from an end portion of the coupling conductor in the second in-plane direction on the first main surface. Each of the branch conductor lines has a base portion branching from the coupling conductor and has a tip portion that is electrically open.

Advantageous Effects of the Invention

In accordance with the present invention, a hollow-waveguide-to-planar-waveguide transition circuit can be provided which is capable of suppressing unnecessary radiation as well as reducing manufacturing cost.

DETAILED DESCRIPTION OF THE EMBODIMENTS

Figure 1:
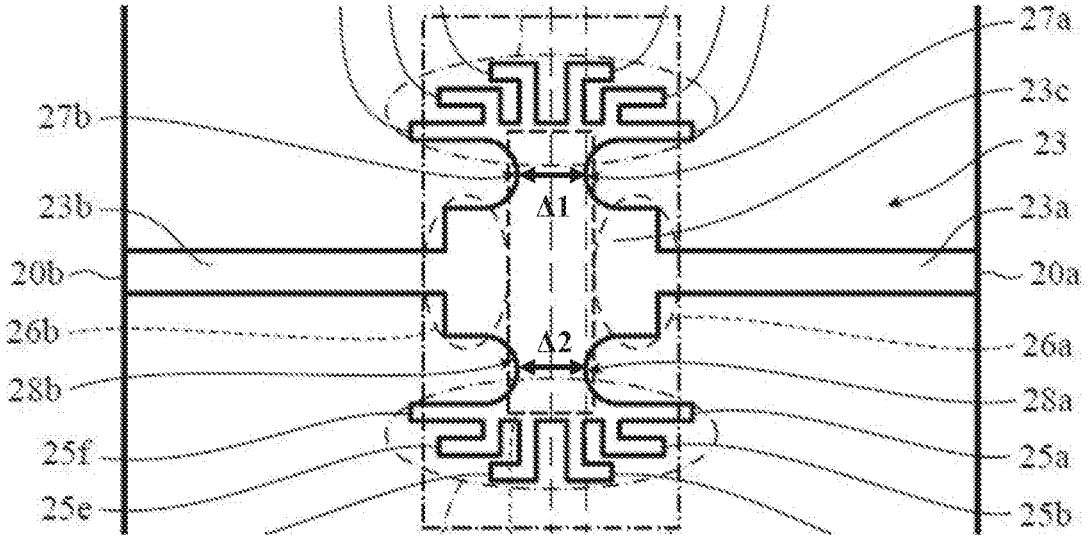
FIG. 1 is a diagram schematically illustrating a planar structure of a hollow-waveguide-to-planar-waveguide transition circuit of a first embodiment according to the present invention.

Hereinafter, various embodiments according to the present invention will be described in detail with reference to the drawings. Note that, constituent elements denoted by the same reference numerals throughout the drawings have the same configuration and the same function. In addition, the X, Y, and Z axes illustrated in the drawings are orthogonal to each other.

First Embodiment

Figure 2:
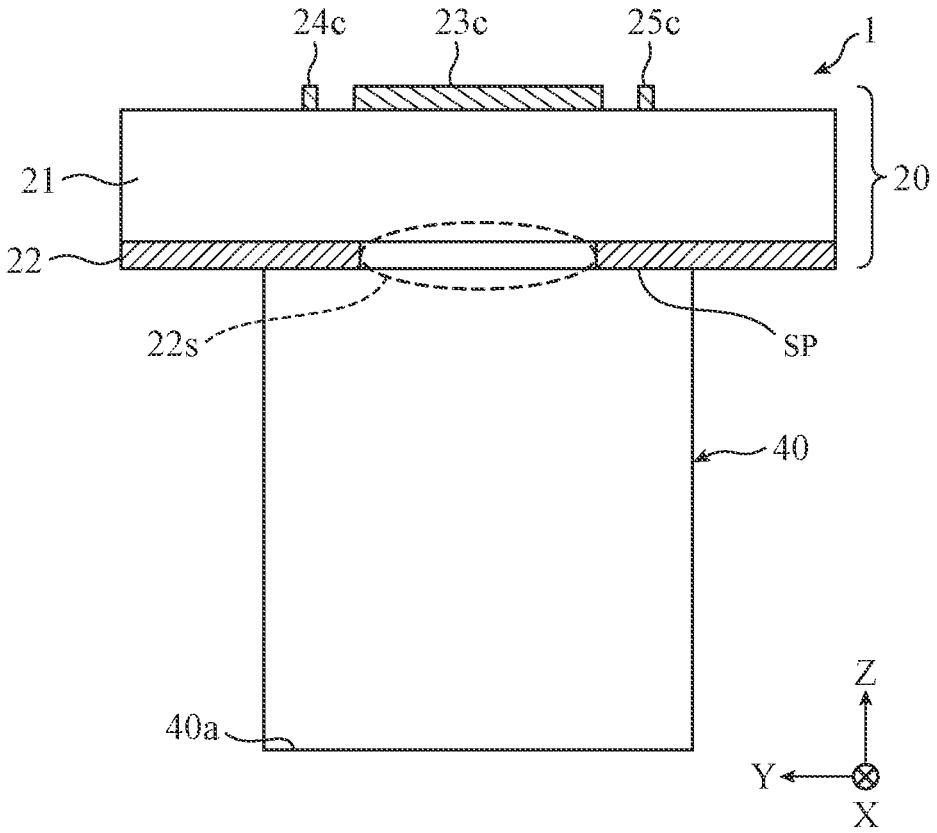
FIG. 2 is a schematic cross-sectional view taken along line II-II of a hollow-waveguide-to-planar-waveguide transition circuit 1 illustrated in FIG. 1.

FIG. 1 is a diagram schematically illustrating a planar structure of a hollow-waveguide-to-planar-waveguide transition circuit 1 of a first embodiment according to the present invention. FIG. 2 is a schematic cross-sectional view taken along line II-II of the hollow-waveguide-to-planar-waveguide transition circuit 1 illustrated in FIG. 1. In the cross-sectional view of FIG. 2, open stubs 24*b* and 25*b* of a conductor pattern 23, illustrated in FIG. 1, to be described later, are not shown.

As illustrated in FIGS. 1 and 2, the hollow-waveguide-to-planar-waveguide transition circuit 1 includes a planar waveguide structure 20 including two input/output ends 20*a* and 20*b*, illustrated in FIG. 1, to be used for inputting and outputting a high-frequency signal, and a hollow waveguide 40 connected to the planar waveguide structure 20. The hollow-waveguide-to-planar-waveguide transition circuit 1 has a function of mutually performing conversion of a transmission mode (particularly a fundamental transmission mode) of the high-frequency signal between the hollow waveguide 40 and the planar waveguide structure 20, and has an impedance conversion function of mutually performing conversion of a characteristic impedance between the hollow waveguide 40 and the planar waveguide structure 20.

The hollow waveguide 40 is a metallic hollow-core waveguide having a rectangular cross section in a plane orthogonal to the guide axis of the hollow waveguide 40, that is, a rectangular waveguide. Although the tube thickness of the hollow waveguide 40 illustrated in FIG. 2 is omitted, actually there is a tube thickness of several millimeters. The hollow path of the hollow waveguide 40 extends along the guide-axis direction (Z-axis direction). The fundamental transmission mode of the hollow waveguide 40 is, for example, a $TE_{10}$ mode that is one of TE modes (transverse electric modes). On the other hand, the fundamental transmission mode of the planar waveguide structure 20 is a quasi-transverse electromagnetic mode (quasi TEM mode). The hollow-waveguide-to-planar-waveguide transition circuit 1 can convert the fundamental transmission mode of the high-frequency signal from one of the $TE_{10}$ mode and the quasi-TEM mode into the other.

The planar waveguide structure 20 includes a dielectric substrate 21 having a rectangular shape such as a square or a rectangle as viewed from the Z-axis direction, and the conductor pattern 23, illustrated in FIG. 1, formed on the front surface (first main surface) of one of two surfaces facing each other of the dielectric substrate 21. Here, the front surface of the dielectric substrate 21 is parallel to the X-Y plane including the X-axis and the Y-axis. The dielectric substrate 21 may include a dielectric material such as glass epoxy, polytetrafluoroethylene (PTFE), or ceramics, for example.

As illustrated in FIG. 1, the conductor pattern 23 includes: two strip conductors 23*a* and 23*b* that are linear conductors extending along an in-plane direction determined in advance (X-axis direction) on the front surface of the dielectric substrate 21; a coupling conductor 23*c* interposed between the strip conductors 23*a* and 23*b* and physically connected to the strip conductors 23*a* and 23*b*; an open stub group 24 including six open stubs (branch conductor lines) 24*a*, 24*b*, 24*c*, 24*d*, 24*e* and 24*f* branching outwardly from the end portion of the coupling conductor 23*c* on the positive side of the Y-axis direction; and an open stub group 25 including six open stubs (branch conductor lines) 25*a*, 25*b*, 25*c*, 25*d*, 25*e* and 25*f* branching outwardly from the end portion of the coupling conductor 23*c* on the negative side of the Y-axis direction.

In addition, as illustrated in FIG. 2, the planar waveguide structure 20 includes: a ground conductor 22 that is a conductive film formed over the entire back surface (second main surface) of the dielectric substrate 21; a slot 22*s* that is a coupling window formed in the ground conductor 22; and the hollow waveguide 40 including one end portion connected to a predetermined region (including the slot 22*s*) of the ground conductor 22. The back surface of the dielectric substrate 21 is parallel to the X-Y plane. As illustrated in FIG. 1, the slot 22*s* extends along the Y-axis direction different from the extending direction (X-axis direction) of the strip conductors 23*a* and 23*b*, and has a rectangular shape whose longitudinal direction is the Y-axis direction.

In addition, the guide-axis direction of the hollow waveguide 40 is parallel to the Z-axis direction. A wall surface forming one end portion of the hollow waveguide 40 on the positive side of the Z-axis direction is physically connected to the ground conductor 22, and forms a shorting plane (short-circuit plane) SP as illustrated in FIG. 2. The external shape of the hollow waveguide 40 illustrated in FIG. 1 is rectangular, and represents the external shape of the shorting plane SP. In addition, the other end portion of the hollow waveguide 40 on the negative side of the Z-axis direction forms an input/output end 40*a* as illustrated in FIG. 2 to be used for inputting/outputting a high-frequency signal.

The ground conductor 22 and the conductor pattern 23 can be formed by a plating process, for example. As the constituent material of the conductor pattern 23 and the ground conductor 22, a material may be used, for example, any one of conductive materials such as copper, silver, and gold, or a combination of two or more materials selected from these conductive materials.

As illustrated in FIGS. 1 and 2, the coupling conductor 23*c* is disposed at a position to face the slot 22*s* provided on the back surface side of the dielectric substrate 21 in the Z-axis direction (thickness direction of the dielectric substrate 21). In addition, as illustrated in FIG. 1, the coupling conductor 23*c* includes a substantially rectangular main body portion (hereinafter referred to as a "main coupling portion") connected to the inner end portions of the strip conductors 23*a* and 23*b*. Impedance adjusting portions 26*a* and 26*b* are formed near both ends of the main coupling portion in the X-axis direction.

The coupling conductor 23*c* further includes a coupling portion (hereinafter referred to as a "first coupling end portion") connected to the base portion of the open stub group 24, and further includes a coupling portion (hereinafter referred to as a "second coupling end portion") connected to the base portion of the open stub group 25. A width (width in the X-axis direction) Δ1 of the first coupling end portion is narrower than a width (width in the X-axis direction) of the main coupling portion. The width Δ1 is formed by a notched portion 27*a* recessed in the X-axis negative direction and a notched portion 27*b* recessed in the X-axis positive direction. Therefore, the notched portions 27*a* and 27*b* are formed to be recessed in directions facing each other. On the other hand, a width (width in the X-axis direction) Δ2 of the second coupling end portion is also narrower than the width (width in the X-axis direction) of the main coupling portion. The width Δ2 is formed by a notched portion 28*a* recessed in the X-axis negative direction and a notched portion 28*b* recessed in the X-axis positive direction. Therefore, the notched portions 28*a* and 28*b* are also formed to be recessed in directions facing each other. Each of the widths Δ1 and Δ2 of the first and second coupling end portions only needs to be formed to be, for example, equal to or more than one eighth (=λ/8) of the wavelength λ corresponding to the center frequency of a predetermined frequency band of use, of the high-frequency signal.

One of the features of the present embodiment is that the conductor pattern 23 includes the open stub groups 24 and 25 to suppress unnecessary radiation from the slot 22*s*. One open stub group 24 includes six open stubs 24*a*, 24*b*, 24*c*, 24*d*, 24*e* and 24*f* branching outwardly from the first coupling end portion of the coupling conductor 23*c*. Among the open stubs 24*a*, 24*b*, 24*c*, 24*d*, 24*e* and 24*f*, the open stubs 24*a* and 24*f* branch in the X-axis positive direction and the X-axis negative direction, respectively, and each have a linear shape. Among the open stubs 24*a*, 24*b*, 24*c*, 24*d*, 24*e* and 24*f*, each of the other open stubs 24*b*, 24*c*, 24*d*, and 24*e* has a bent shape. Because the tip portions of the open stubs 24*a*, 24*b*, 24*c*, 24*d*, 24*e* and 24*f* are electrically insulated, the tip portions are each in an electrically open state.

In addition, the length from the base portion to the tip portion of each of the open stubs 24*a*, 24*b*, 24*c*, 24*d*, 24*e* and 24*f* is designed to be equal to a quarter (=λ/4) of the wavelength λ. Therefore, when the hollow-waveguide-to-planar-waveguide transition circuit 1 operates in the frequency band of use, the base portion of each of the open stubs of the open stub group 24 is equivalently in an electrical short-circuit state with respect to the center frequency.

The other open stub group 25 also includes six open stubs 25*a*, 25*b*, 25*c*, 25*d*, 25*e* and 25*f* branching outwardly from the second coupling end portion of the coupling conductor 23*c*. Among the open stubs 25*a*, 25*b*, 25*c*, 25*d*, 25*e* and 25*f*, the two open stubs 25*a* and 25*f* branch in the X-axis positive direction and the X-axis negative direction, respectively. Among the open stubs 25*a*, 25*b*, 25*c*, 25*d*, 25*e* and 25*f*, each of the other open stubs 25*b*, 25*c*, 25*d*, and 25*e* has a bent shape. Because the tip portions of the open stubs 25*a*, 25*b*, 25*c*, 25*d*, 25*e* and 25*f* are electrically insulated, the tip portions are each in an electrically open state. In addition, the length from the base portion to the tip portion of each of the open stubs 25*a*, 25*b*, 25*c*, 25*d*, 25*e* and 25*f* is designed to be equal to a quarter (=λ/4) of the wavelength λ. Therefore, when the hollow-waveguide-to-planar-waveguide transition circuit 1 operates in the frequency band to be used, the base portion of each of the open stubs of the open stub group 25 is also equivalently in an electrical short-circuit state with respect to the center frequency.

Next, the operation will be described of the hollow-waveguide-to-planar-waveguide transition circuit 1 of the present embodiment with reference to FIGS. 1 and 2.

In the planar waveguide structure 20 of the present embodiment, a microstrip line is formed by the strip conductors 23*a* and 23*b*, the ground conductor 22 facing the strip conductors 23*a* and 23*b*, and a dielectric interposed between the ground conductor 22 and the strip conductors 23*a* and 23*b*. In addition, a parallel plate line is formed by the coupling conductor 23*c*, the ground conductor 22 facing the coupling conductor 23*c*, and a dielectric interposed between the ground conductor 22 and the coupling conductor 23*c*.

When a high-frequency signal is input to the input/output end 40*a* of the hollow waveguide 40, the high-frequency signal input excites the slot 22*s*. Because the longitudinal direction of the slot 22*s* intersects the longitudinal direction (extending direction) of the strip conductors 23*a* and 23*b*, the slot 22*s* excited and the strip conductors 23*a* and 23*b* are magnetically coupled to each other. The high-frequency signal propagates through the parallel plate line to the input/output ends 20*a* and 20*b* of the microstrip line and is output. At this time, the slot 22*s* is excited in the same phase. The strip conductors 23*a* and 23*b* are arranged to extend in opposite directions to each other with respect to the slot 22*s*. Therefore, outputs are made in opposite phases from the input/output ends 20*a* and 20*b*. Because the tip portions of the open stubs 24*a*, 24*b*, 24*c*, 24*d*, 24*e*, 24*f*, 25*a*, 25*b*, 25*c*, 25*d*, 25*e* and 25*f* are each in an electrically open state, the base portions of the open stubs 24*a*, 24*b*, 24*c*, 24*d*, 24*e*, 24*f*, 25*a*, 25*b*, 25*c*, 25*d*, 25*e* and 25*f* are each in an electrical short-circuit state. Therefore, the high-frequency signal is shielded at the connecting portions of the coupling conductor 23*c* with the open stub groups 24 and 25, that is, the first and second coupling end portions. As a result, unnecessary radiation can be suppressed.

Conversely, when high-frequency signals in opposite phases are each input to the input/output ends 20*a* and 20*b* of the planar waveguide structure 20, the high-frequency signals are synthesized and then output from the input/output end 40*a* of the hollow waveguide 40.

Figure 3:
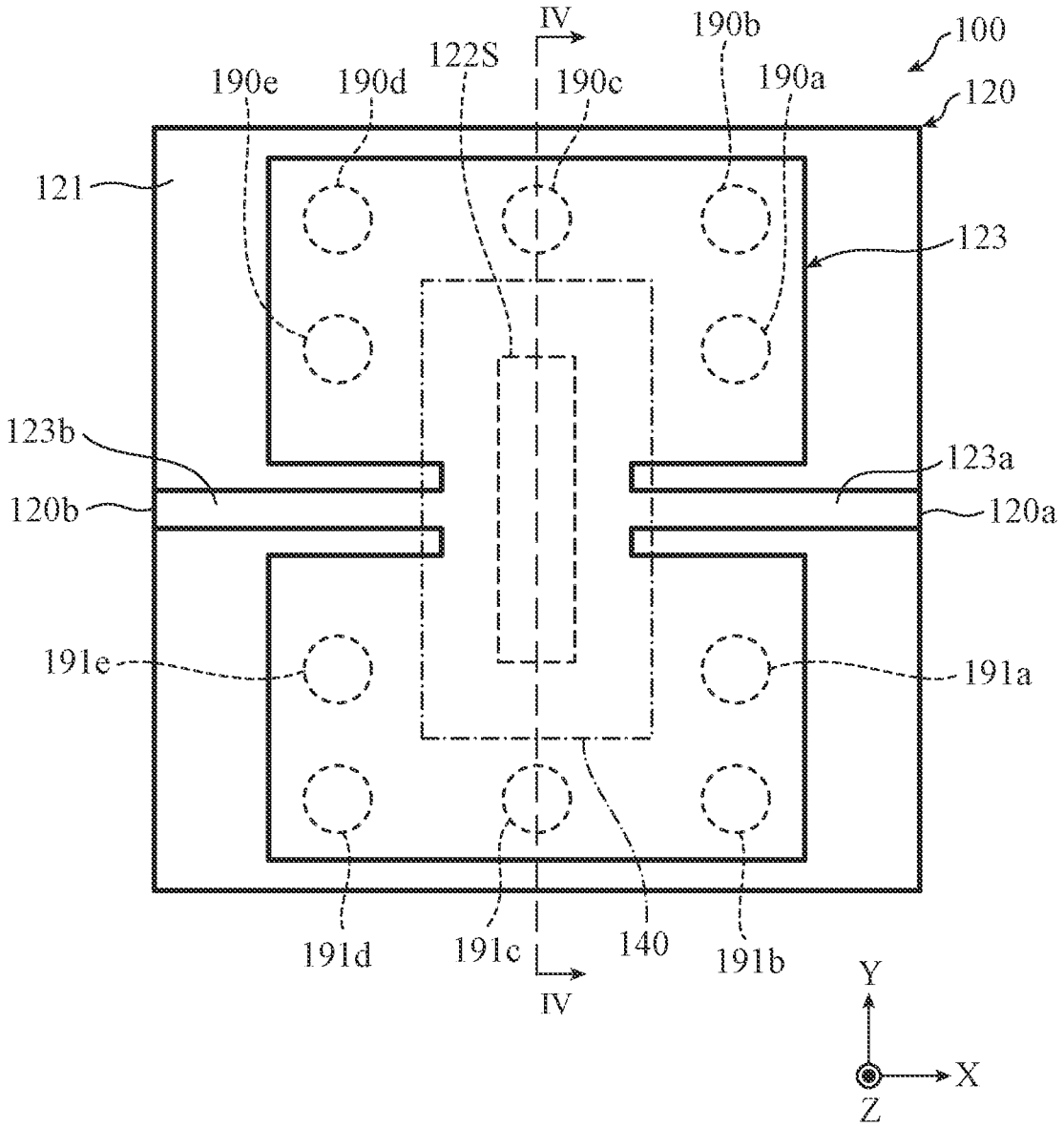
FIG. 3 (Prior Art)
FIG. 3 is a schematic plan view of a conventional hollow-waveguide-to-microstrip-line transition circuit.
Figure 4:
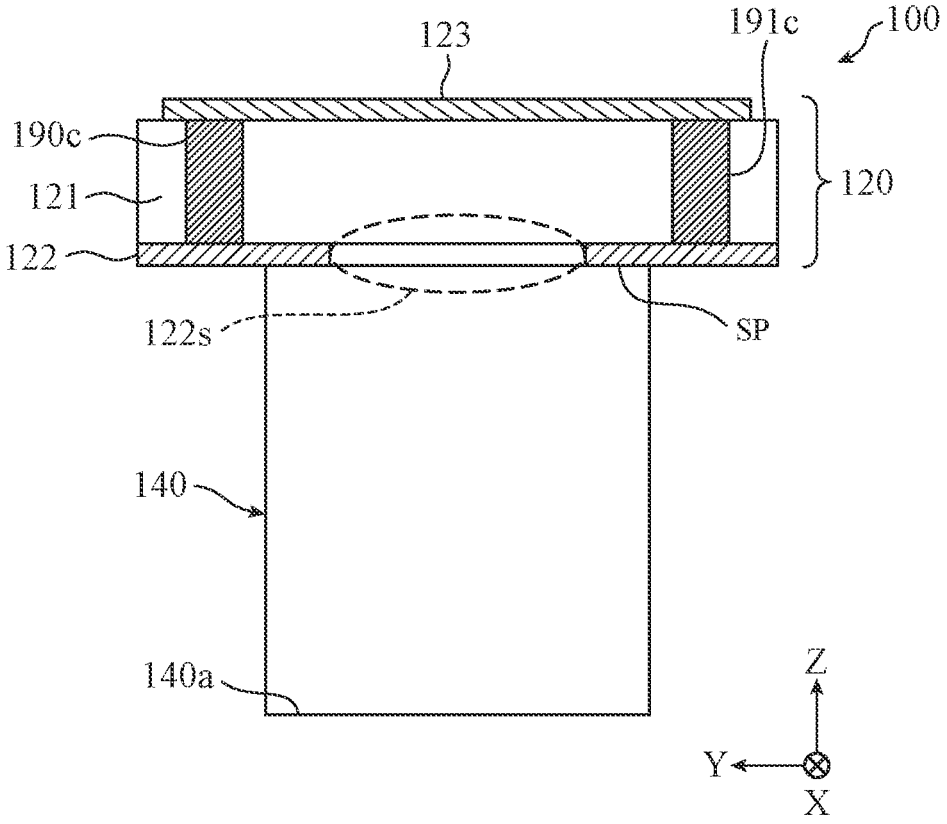
FIG. 4 (Prior Art)
FIG. 4 is a schematic cross-sectional view taken along line IV-IV of the hollow-waveguide-to-microstrip-line transition circuit illustrated in FIG. 3.

With the hollow-waveguide-to-planar-waveguide transition circuit 1 of the present embodiment, unnecessary radiation can be suppressed without requiring a connecting conductor for connecting the conductor pattern 23 on the front surface of the dielectric substrate 21 and the ground conductor 22 on the back surface of the dielectric substrate 21 to each other. FIG. 3 is a diagram schematically illustrating a planar waveguide structure 120 of a conventional hollow-waveguide-to-microstrip-line transition circuit 100 including that kind of connecting conductors 190*a*, 190*b*, 190*c*, 190*d*, 190*e*, 191*a*, 191*b*, 191*c*, 191*d* and 191*e*. FIG. 4 is a schematic cross-sectional view taken along line IV-IV of the hollow-waveguide-to-microstrip-line transition circuit 100 illustrated in FIG. 3. A configuration substantially the same as that of the hollow-waveguide-to-microstrip-line transition circuit 100 is disclosed in Patent Literature 1 (Japanese Patent Application Publication No. 2010-56920).

As illustrated in FIG. 3, the planar waveguide structure 120 of the hollow-waveguide-to-microstrip-line transition circuit 100 includes: strip conductors 123*a* and 123*b* formed on the front surface of a dielectric substrate 121; a conductor plate 123 formed to connect to the strip conductors 123*a* and 123*b* on the front surface; a ground conductor 122 illustrated in FIG. 4 which is formed on the back surface of the dielectric substrate 121; a rectangular slot 122S formed in the ground conductor 122 as illustrated in FIG. 4; and the cylindrical connecting conductors 190*a*, 190*b*, 190*c*, 190*d*, 190*e*, 191*a*, 191*b*, 191*c*, 191*d* and 191*e* provided in the dielectric substrate 121, and connecting the conductor plate 123 and the ground conductor 122 to each other. As illustrated in FIG. 4, an end portion of a rectangular waveguide 140 is in contact with the ground conductor 122 to form a shorting plane (short-circuit plane) SP. The connecting conductors 190*a*, 190*b*, 190*c*, 190*d*, 190*e*, 191*a*, 191*b*, 191*c*, 191*d* and 191*e* are arranged around the periphery of the shorting plane SP of the rectangular waveguide 140.

When a high-frequency signal is input to an input/output end 140*a* of the hollow waveguide 140, the high-frequency signal input excites the slot 122S. Because the longitudinal direction of the slot 122S intersects the longitudinal direction of the strip conductors 123*a* and 123*b* illustrated in FIG. 3, the slot 122S excited and the strip conductors 123*a* and 123*b* are magnetically coupled to each other. The high-frequency signal is output from input/output ends 120*a* and 120*b*, illustrated in FIG. 3, of the microstrip line formed by the strip conductors 123*a* and 123*b*, and the ground conductor 122, via a parallel plate line formed by the conductor plate 123 and the ground conductor 122. With the hollow-waveguide-to-microstrip-line transition circuit 100, by providing the connecting conductors 190*a*, 190*b*, 190*c*, 190*d*, 190*e*, 191*a*, 191*b*, 191*c*, 191*d* and 191*e* illustrated in FIG. 3, unnecessary radiation from the slot 122S can be suppressed.

To provide the connecting conductors 190*a*, 190*b*, 190*c*, 190*d*, 190*e*, 191*a*, 191*b*, 191*c*, 191*d* and 191*e*, for example, steps are required of a step of forming a through-hole penetrating between the front surface and the back surface in the dielectric substrate 121, and a step of forming a conductor within the through-hole (for example, a plating step and an etching step). However, these steps complicate the manufacturing step of the hollow-waveguide-to-microstrip-line transition circuit 100, and cause an increase in manufacturing cost.

In addition, when the dielectric substrate 121 of the hollow-waveguide-to-microstrip-line transition circuit 100 expands and contracts due to temperature change, tension is applied to the connecting conductors 190*a*, 190*b*, 190*c*, 190*d*, 190*e*, 191*a*, 191*b*, 191*c*, 191*d* and 191*e*. This possibly causes the connecting conductors 190*a*, 190*b*, 190*c*, 190*d*, 190*e*, 191*a*, 191*b*, 191*c*, 191*d* and 191*e* to be broken, or possibly deteriorates the characteristic of the hollow-waveguide-to-microstrip-line transition circuit 100.

On the other hand, the hollow-waveguide-to-planar-waveguide transition circuit 1 of the present embodiment can suppress unnecessary radiation without requiring the connecting conductor, so that a low manufacturing cost and a high operation reliability can be achieved as compared with the hollow-waveguide-to-microstrip-line transition circuit 100.

Meanwhile, referring to FIG. 1, the structure of the hollow-waveguide-to-planar-waveguide transition circuit 1 of the present embodiment is designed to have geometric symmetry with respect to a plane (plane parallel to the Y-Z plane) in a line B1-B2 passing through the center of the coupling conductor 23*c*. For this reason, during operation of the hollow-waveguide-to-planar-waveguide transition circuit 1, an electrical short-circuit state occurs in the plane in the line B1-B2. Provisionally, it is assumed that the open stub groups 24 and 25 do not exist. At this time, when a relative positional deviation occurs between the coupling conductor 23*c* and the slot 22*s* due to a manufacturing error, temperature change, aging degradation, or the like, and its geometric symmetry is lost, a surface region where the electrical short-circuit state occurs, that is, an electric wall may be greatly curved. In this case, a deviation in the distribution characteristic occurs between the high-frequency signals propagating to the strip conductors 23*a* and 23*b*, thereby deteriorating the transition circuit characteristic.

On the other hand, the hollow-waveguide-to-planar-waveguide transition circuit 1 of the present embodiment includes the open stub groups 24 and 25. As illustrated in FIG. 1, as viewed from the Z-axis direction (thickness direction of the dielectric substrate 21), one open stub group 24 is disposed around the periphery of one end portion of the slot 22*s* in the longitudinal direction of the slot 22*s*, and the other open stub group 25 is disposed around the periphery of the other end portion of the slot 22*s* in the longitudinal direction of the slot 22*s*. By providing the open stub groups 24 and 25 in this way, even if the positional deviation occurs between the coupling conductor 23*c* and the slot 22*s*, multiple electrical short-circuit points are formed between the coupling conductor 23*c* and the open stub groups 24 and 25, whereby the curvature of the electric wall is suppressed. Therefore, the electrical symmetry of the hollow-waveguide-to-planar-waveguide transition circuit 1 is easily maintained. In addition, because the open stub groups 24 and 25 branch from the first and second coupling end portions of the coupling conductor 23*c*, even if the manufacturing error, temperature change, aging degradation, or the like occurs, a distribution characteristic difference can be suppressed between the high-frequency signals each propagating to the strip conductors 23*a* and 23*b*. Therefore, the hollow-waveguide-to-planar-waveguide transition circuit 1 can be provided having a high operational reliability.

In addition, by narrowing the width of each of the open stubs 24*a*, 24*b*, 24*c*, 24*d*, 24*e*, 24*f*, 25*a*, 25*b*, 25*c*, 25*d*, 25*e* and 25*f*, the unloaded Q value of each of the open stubs 24*a*, 24*b*, 24*c*, 24*d*, 24*e*, 24*f*, 25*a*, 25*b*, 25*c*, 25*d*, 25*e* and 25*f* is increased, and the radiation loss can be suppressed. From this viewpoint, the width of each of the open stubs is desirably set to, for example, one tenth ($=\lambda/10$) or less of the wavelength $\lambda$.

Further, because each of the open stubs 24*b*, 24*c*, 24*d*, 24*e*, 25*b*, 25*c*, 25*d* and 25*e* in the present embodiment has a bent shape, the hollow-waveguide-to-planar-waveguide transition circuit 1 can be achieved having a small external dimension.

As described above, because the hollow-waveguide-to-planar-waveguide transition circuit 1 according to the present embodiment includes the open stub groups 24 and 25, a low manufacturing cost and a high operation reliability can be achieved while unnecessary radiation is suppressed.

In addition, as illustrated in FIG. 1, the coupling conductor 23*c* includes the substantially rectangular main coupling portion connected to the inner end portions of the strip conductors 23*a* and 23*b*, the first coupling end portion connected to the base portion of the open stub group 24, and the second coupling end portion connected to the base portion of the open stub group 25. As described above, the width (the width in the X-axis direction) $\Delta 1$ of the first coupling end portion formed between the notched portions 27*a* and 27*b* is narrower than the width (width in the X-axis direction) of the main coupling portion. In addition, the width (width in the X-axis direction) $\Delta 2$ of the second coupling end portion formed between the notched portions 28*a* and 28*b* is also narrower than the width (width in the X-axis direction) of the main coupling portion. For this reason, an electrical short-circuit state can be produced stably.

Second Embodiment

The first embodiment has the structure in which the strip conductors 23*a* and 23*b* and the coupling conductor 23*c* are physically connected to each other in the impedance adjusting portions 26*a* and 26*b*, although no limitation thereto is intended. The first embodiment may be modified to include a structure including strip conductors and a coupling conductor physically separated from each other in the impedance adjusting portions. Hereinafter, second and third embodiments will be described each including such a structure.

Figure 5:
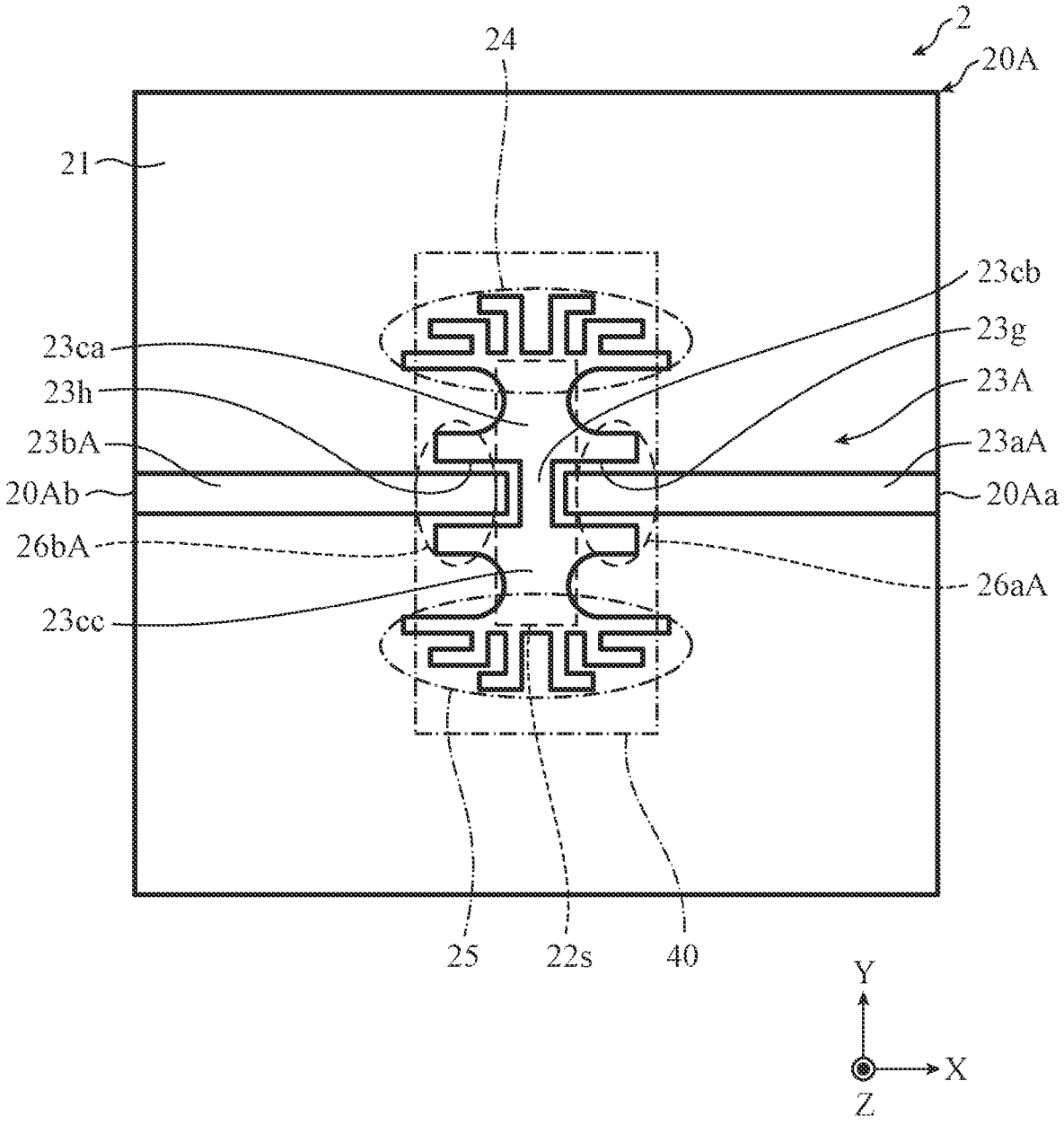
FIG. 5 is a schematic plan view of a hollow-waveguide-to-planar-waveguide transition circuit of a second embodiment according to the present invention.

FIG. 5 is a diagram schematically illustrating a planar structure of a hollow-waveguide-to-planar-waveguide transition circuit 2 of the second embodiment that is a first modification of the first embodiment. The configuration of the hollow-waveguide-to-planar-waveguide transition circuit 2 is the same as that of the hollow-waveguide-to-planar-waveguide transition circuit 1 of the first embodiment except that a conductor pattern 23A of FIG. 5 is included instead of the conductor pattern 23 of FIG. 1. In addition, the step of forming the conductor pattern 23A is the same as the step of forming the conductor pattern 23.

The hollow-waveguide-to-planar-waveguide transition circuit 2 of the present embodiment includes a planar waveguide structure 20A including input/output ends 20Aa and 20Ab as illustrated in FIG. 5, and the planar waveguide structure 20A includes the conductor pattern 23A on the front surface of the dielectric substrate 21. The conductor pattern 23A includes: strip conductors 23*a*A and 23*b*A physically separated from each other in the X-axis direction; the open stub groups 24 and 25; a first coupling conductor 23*ca* connected to the open stub group 24; a second coupling conductor 23*cc* connected to the open stub group 25; and a connecting portion 23*cb* connecting the first coupling conductor 23*ca* and the second coupling conductor 23*cc* to each other. The connecting portion 23*cb* is disposed to be interposed between the strip conductors 23*a*A and 23*b*A, and to be physically separated from the strip conductors 23*a*A and 23*b*A. The first coupling conductor 23*ca* has the same pattern shape as that of the first coupling end portion of the coupling conductor 23*c* of the first embodiment illustrated in FIG. 1, and the second coupling conductor 23*cc* has the same pattern shape as that of the second coupling end portion of the coupling conductor 23*c* of the first embodiment illustrated in FIG. 1.

In addition, the first coupling conductor 23*ca*, the connecting portion 23*cb*, and the second coupling conductor 23*cc* form a recessed portion 23*g* recessed in the X-axis negative direction and a recessed portion 23*h* recessed in the X-axis positive direction. The inner end portion of one strip conductor 23*a*A is surrounded by the recessed portion 23*g*, and the inner end portion of the other strip conductor 23*b*A is surrounded by the recessed portion 23*h*. The coupling conductor of the present embodiment is configured by the first coupling conductor 23*ca*, the connecting portion 23*cb*, and the second coupling conductor 23*cc* as described above. The structure of the coupling conductor of the present embodiment is substantially the same as a structure in which the recessed portions 23*g* and 23*h* are formed by processing the coupling conductor 23*c* of the first embodiment. As illustrated in FIG. 5, impedance adjusting portions 26*a*A and 26*b*A of the present embodiment are respectively formed near the recessed portions 23*g* and 23*h*.

Because the hollow-waveguide-to-planar-waveguide transition circuit 2 of the present embodiment also includes the open stub groups 24 and 25 as in the first embodiment, a low manufacturing cost and a high operation reliability can be achieved while unnecessary radiation is suppressed.

Third Embodiment

Figure 6:
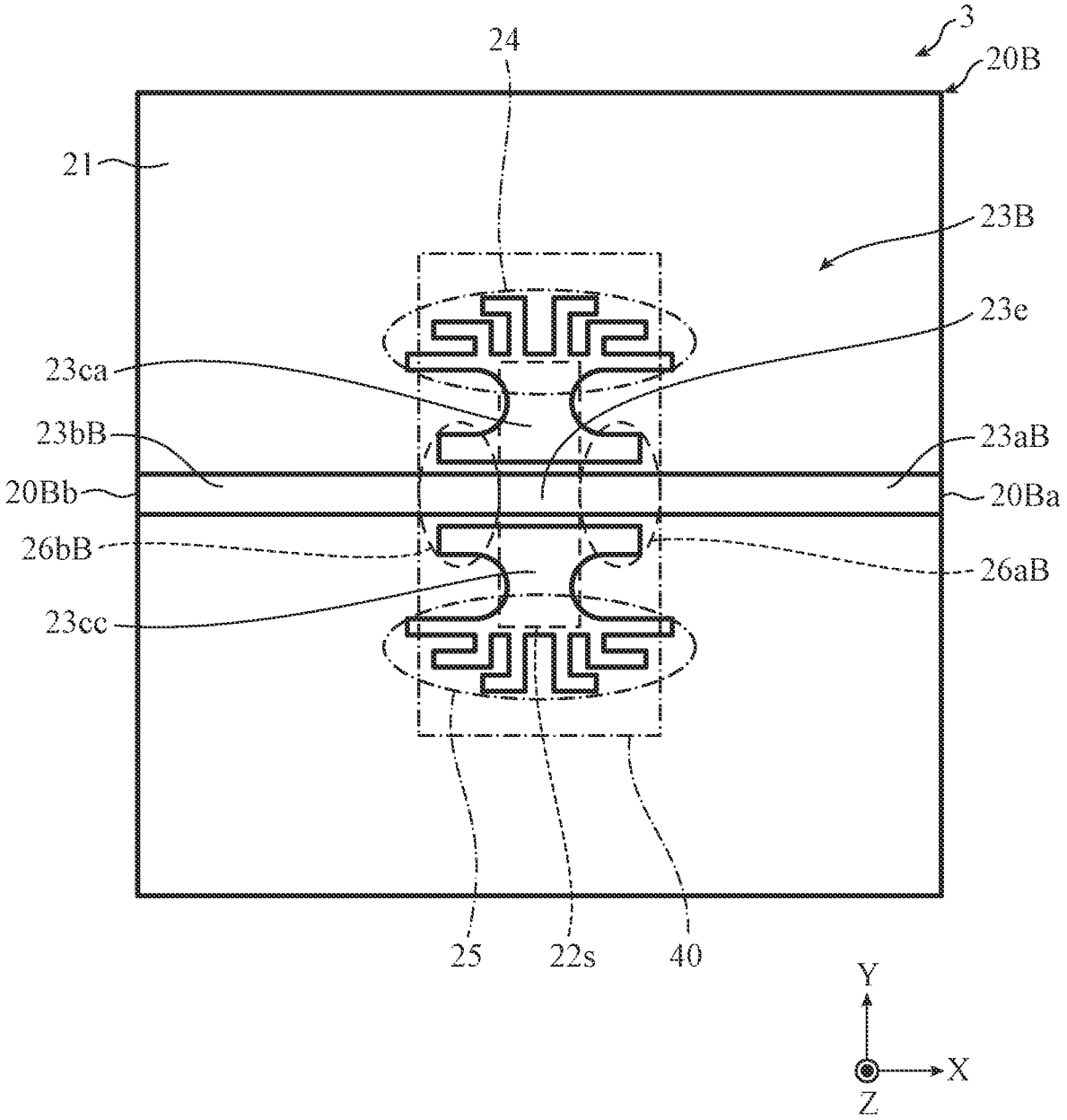
FIG. 6 is a schematic plan view of a hollow-waveguide-to-planar-waveguide transition circuit of a third embodiment according to the present invention.

FIG. 6 is a diagram schematically illustrating a planar structure of a hollow-waveguide-to-planar-waveguide transition circuit 3 of the third embodiment that is a second modification of the first embodiment. The configuration of the hollow-waveguide-to-planar-waveguide transition circuit 3 is the same as that of the hollow-waveguide-to-planar-waveguide transition circuit 1 of the first embodiment except that a conductor pattern 23B of FIG. 6 is included instead of the conductor pattern 23 of FIG. 1. In addition, the step of forming the conductor pattern 23B is the same as the step of forming the conductor pattern 23 of FIG. 1.

The hollow-waveguide-to-planar-waveguide transition circuit 3 of the present embodiment includes a planar waveguide structure 20B including input/output ends 20Ba and 20Bb as illustrated in FIG. 6, and the planar waveguide structure 20B includes the conductor pattern 23B on the front surface of the dielectric substrate 21. The conductor pattern 23B includes: strip conductors 23*a*B and 23*b*B connected to each other via a connecting portion 23*e* in the X-axis direction; the open stub groups 24 and 25; the first coupling conductor 23*ca* connected to the open stub group 24; and the second coupling conductor 23*cc* connected to the open stub group 25. The first coupling conductor 23*ca* and the second coupling conductor 23*cc* are physically separated from each other, and the strip conductors 23*a*B and 23*b*B and the connecting portion 23*e* are arranged in a region between the first coupling conductor 23*ca* and the second coupling conductor 23*cc*. As in the case of the second embodiment, the first coupling conductor 23*ca* has the same pattern shape as that of the first coupling end portion of the coupling conductor 23*c* of the first embodiment illustrated in FIG. 1, and the second coupling conductor 23*cc* has the same pattern shape as that of the second coupling end portion of the coupling conductor 23*c* of the first embodiment illustrated in FIG. 1. The coupling conductor of the present embodiment is configured by the first coupling conductor 23*ca* and the second coupling conductor 23*cc* as described above. As illustrated in FIG. 6, impedance adjusting portions 26*a*B and 26*b*B of the present embodiment are respectively formed near both ends of the first coupling conductor 23*ca* and the second coupling conductor 23*cc* in the X-axis direction.

Because the hollow-waveguide-to-planar-waveguide transition circuit 3 of the present embodiment also includes the open stub groups 24 and 25 as in the first embodiment, a low manufacturing cost and a high operation reliability can be achieved while unnecessary radiation is suppressed.

Fourth Embodiment

Each of the hollow-waveguide-to-planar-waveguide transition circuits 1 to 3 of the first to third embodiments described above has a single slot 22*s*, although no limitation thereto is intended. The first to third embodiments may be modified to have two or more slots. Hereinafter, fourth and fifth embodiments will be described each having a plurality of slots.

Figure 7:
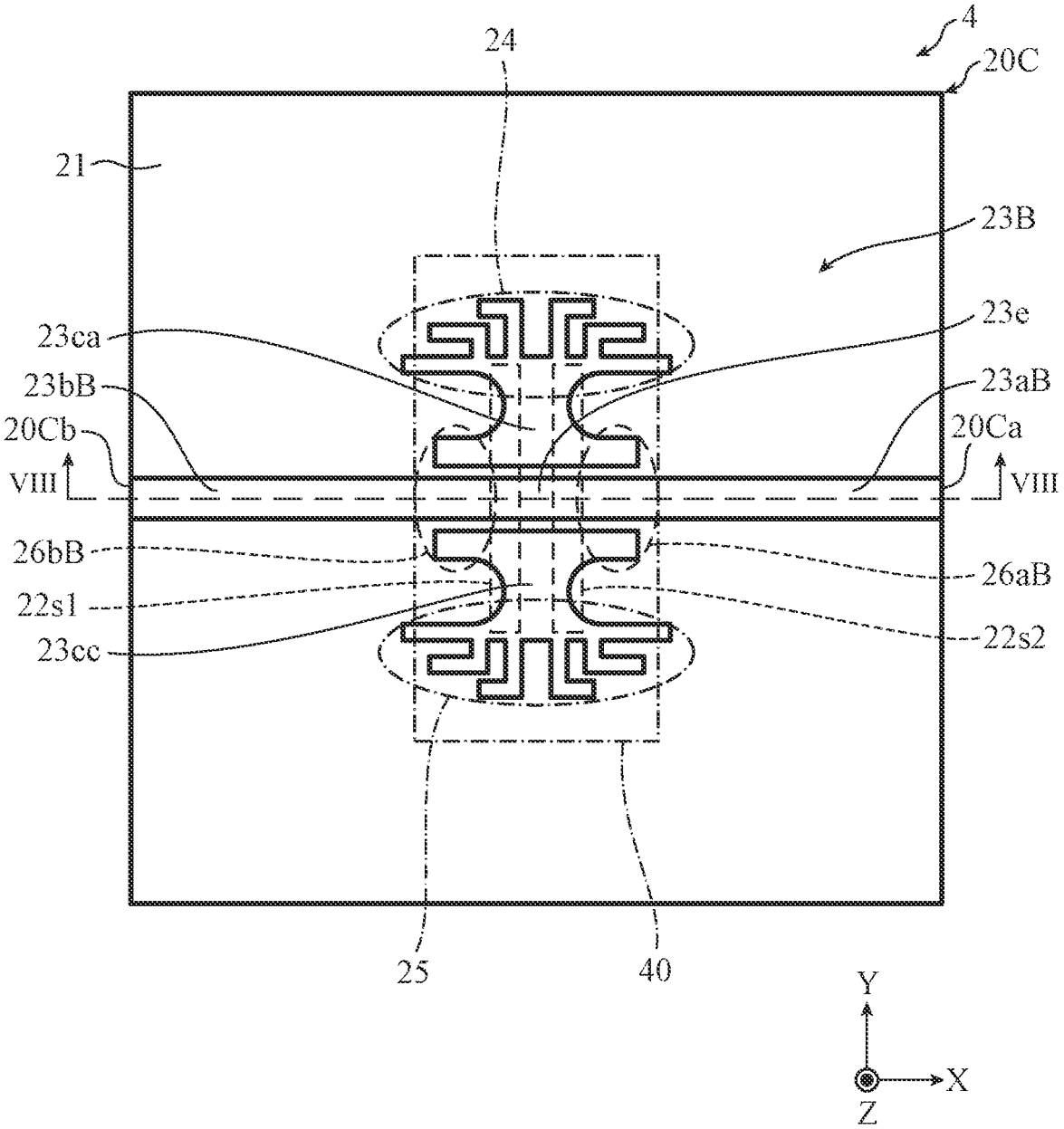
FIG. 7 is a schematic plan view of a hollow-waveguide-to-planar-waveguide transition circuit of a fourth embodiment according to the present invention.
Figure 8:
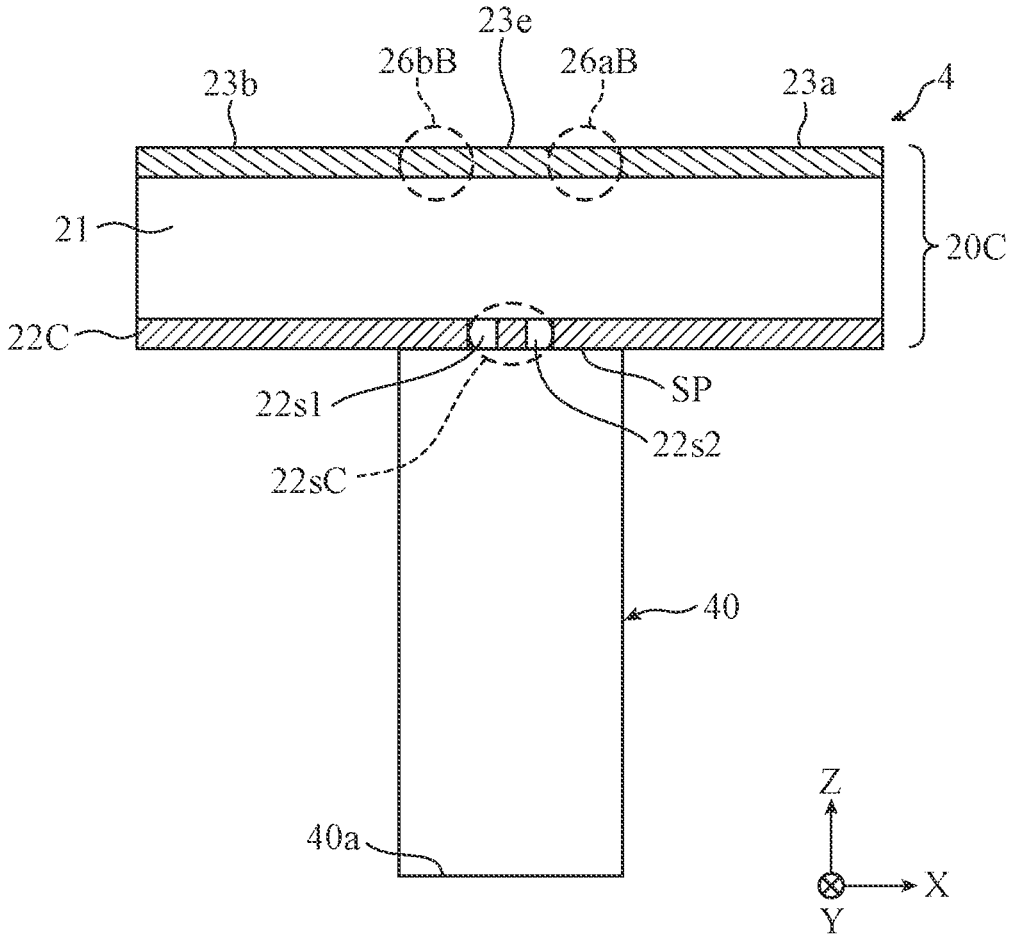
FIG. 8 is a schematic cross-sectional view taken along line VIII-VIII of the hollow-waveguide-to-planar-waveguide transition circuit illustrated in FIG. 7.

FIG. 7 is a diagram schematically illustrating a planar structure of a hollow-waveguide-to-planar-waveguide transition circuit 4 of the fourth embodiment that is a modification of the third embodiment (FIG. 6). In addition, FIG. 8 is a schematic cross-sectional view taken along line VIII- VIII of the hollow-waveguide-to-planar-waveguide transition circuit 4 illustrated in FIG. 7. The configuration of the hollow-waveguide-to-planar-waveguide transition circuit 4 is the same as that of the hollow-waveguide-to-planar-waveguide transition circuit 3 of the third embodiment except that two slots 22*s*1 and 22*s*2 are included illustrated in FIG. 8.

The hollow-waveguide-to-planar-waveguide transition circuit 4 of the present embodiment includes a planar waveguide structure 20C including input/output ends 20Ca and 20Cb as illustrated in FIG. 7, and the planar waveguide structure 20C includes the conductor pattern 23B on the front surface of the dielectric substrate 21 as illustrated in FIG. 7. As illustrated in FIG. 8, a ground conductor 22C is provided on the back surface of the dielectric substrate 21. In the ground conductor 22C, a slot group 22*s*C is formed including the rectangular slots 22*s*1 and 22*s*2 which extend in the Y-axis direction as illustrated in FIG. 7. The strip conductors 23*a*B and 23*b*B illustrated in FIG. 7 are arranged to extend in opposite directions to each other (X-axis positive direction and X-axis negative direction) with respect to the slot group 22*s*C. Because the hollow-waveguide-to-planar-waveguide transition circuit 4 of the present embodiment also includes the open stub groups 24 and 25 illustrated in FIG. 7 as in the first embodiment, a low manufacturing cost and a high operation reliability can be achieved while unnecessary radiation is suppressed.

Fifth Embodiment

Figure 9:
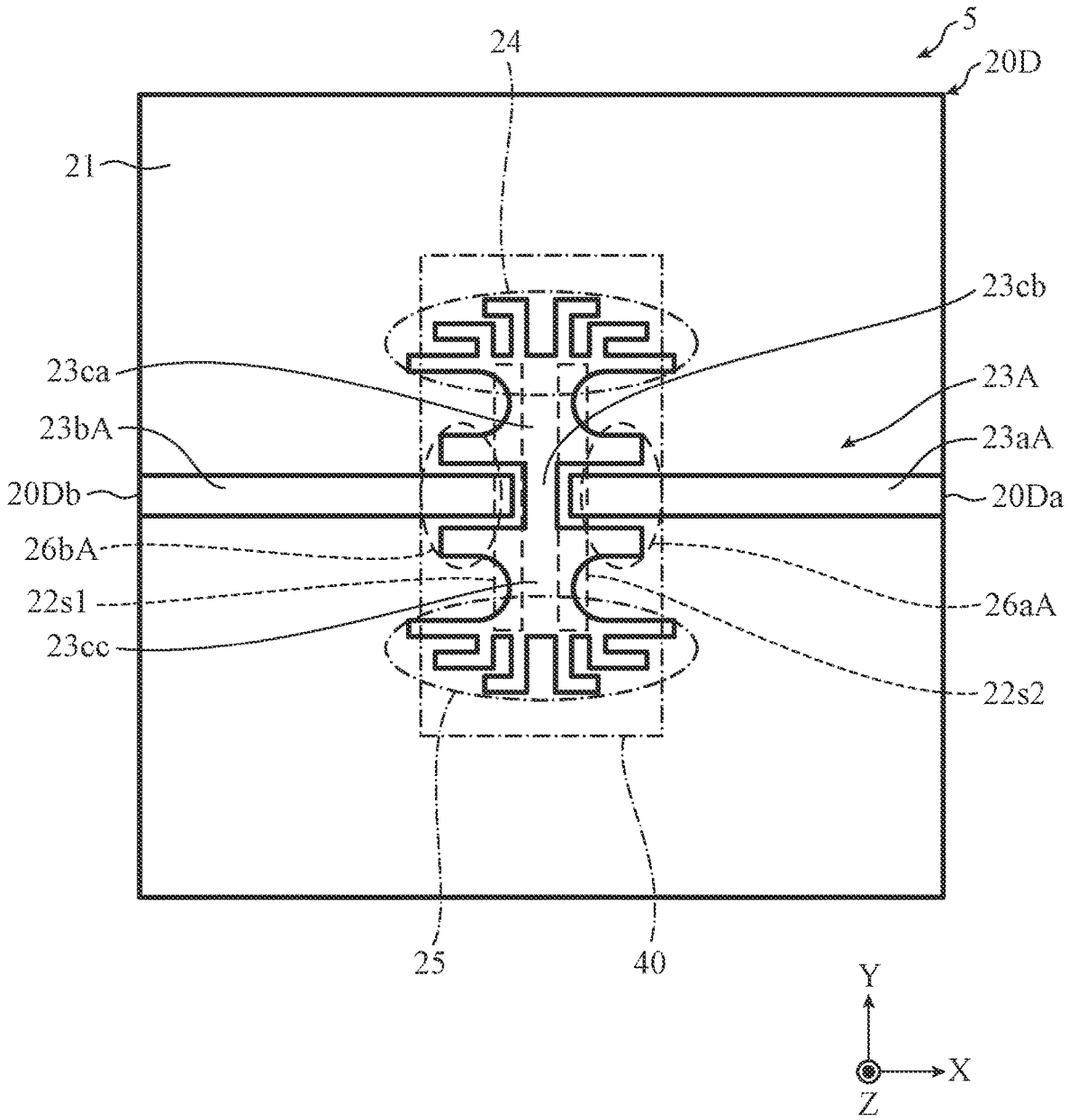
FIG. 9 is a schematic plan view of a hollow-waveguide-to-planar-waveguide transition circuit of a fifth embodiment according to the present invention.

FIG. 9 is a diagram schematically illustrating a planar structure of the hollow-waveguide-to-planar-waveguide transition circuit 5 of the fifth embodiment that is a modification of the second embodiment (FIG. 5). The configuration of the hollow-waveguide-to-planar-waveguide transition circuit 5 is the same as that of the hollow-waveguide-to-planar-waveguide transition circuit 2 of the second embodiment except that the two slots 22*s*1 and 22*s*2 illustrated in FIG. 9 are included as in the fourth embodiment.

The hollow-waveguide-to-planar-waveguide transition circuit 5 of the present embodiment includes a planar waveguide structure 20D including input/output ends 20Da and 20Db as illustrated in FIG. 9, and the planar waveguide structure 20D includes the conductor pattern 23A on the front surface of the dielectric substrate 21. Because the hollow-waveguide-to-planar-waveguide transition circuit 5 of the present embodiment also includes the open stub groups 24 and 25 as in the first embodiment, a low manufacturing cost and a high operation reliability can be achieved while unnecessary radiation is suppressed.

Sixth Embodiment

As illustrated in FIG. 1, the coupling conductor 23*c* of the first embodiment includes the substantially rectangular main coupling portion connected to the inner end portions of the strip conductors 23*a* and 23*b*, and the impedance adjusting portions 26*a* and 26*b* are formed near both ends of the main coupling portion in the X-axis direction. The external shape of the main coupling portion of the coupling conductor 23*c* is substantially rectangular, although no limitation thereto is intended. The conductor pattern 23 of the first embodiment may be modified to include a coupling conductor having a stair shape or a tapered shape in the impedance adjusting portion. In the following, descriptions will be made of a sixth embodiment that includes a conductor pattern including a coupling conductor having a stair shape in the impedance adjusting portion, and a seventh embodiment that includes a conductor pattern including a coupling conductor having a tapered shape in the impedance adjusting portion.

Figure 10:
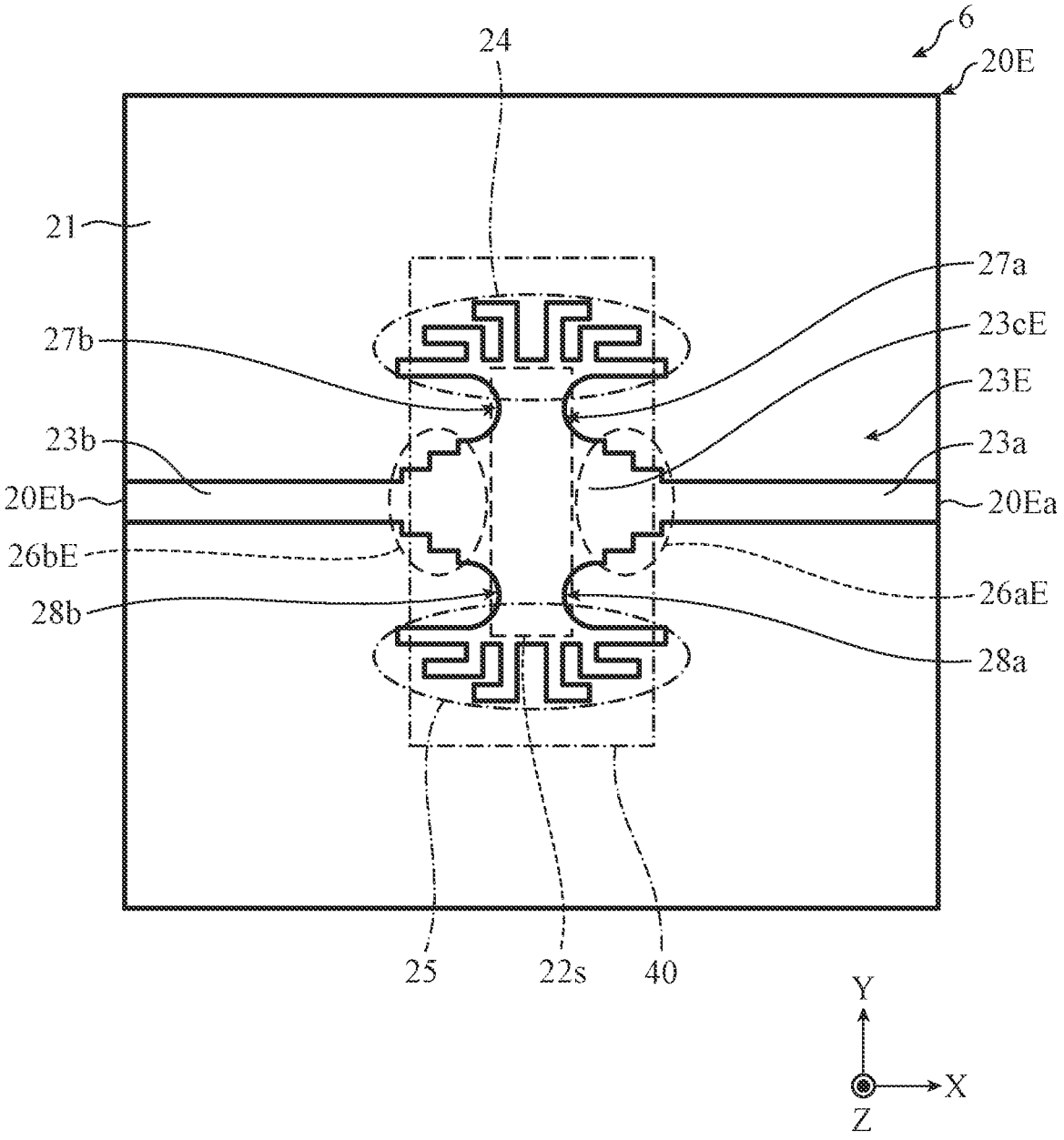
FIG. 10 is a schematic plan view of a hollow-waveguide-to-planar-waveguide transition circuit of a sixth embodiment according to the present invention.

FIG. 10 is a diagram schematically illustrating a planar structure of a hollow-waveguide-to-planar-waveguide transition circuit 6 of the sixth embodiment that is a third modification of the first embodiment. The configuration of the hollow-waveguide-to-planar-waveguide transition circuit 6 is the same as that of the hollow-waveguide-to-planar-waveguide transition circuit 1 of the first embodiment except that a conductor pattern 23E of FIG. 10 is included instead of the conductor pattern 23 of FIG. 1. In addition, the step of forming the conductor pattern 23E is the same as the step of forming the conductor pattern 23.

The hollow-waveguide-to-planar-waveguide transition circuit 6 of the present embodiment includes a planar waveguide structure 20E including input/output ends 20Ea and 20Eb as illustrated in FIG. 10, and the planar waveguide structure 20E includes the conductor pattern 23E on the front surface of the dielectric substrate 21. The shape of the conductor pattern 23E is the same as the shape of the conductor pattern 23 of the first embodiment except that a coupling conductor 23*c*E of FIG. 10 is included instead of the coupling conductor 23*c* of FIG. 1.

Similarly to the coupling conductor 23*c*, the coupling conductor 23*c*E of the present embodiment is disposed at a position to face the slot 22*s* provided on the back surface side of the dielectric substrate 21 in the Z-axis direction (thickness direction of the dielectric substrate 21). In addition, as illustrated in FIG. 10, the coupling conductor 23*c*E includes a main coupling portion connected to the inner end portions of the strip conductors 23*a* and 23*b*. Impedance adjusting portions 26*a*E and 26*b*E are formed near both ends of the main coupling portion in the X-axis direction. In addition, as in the first embodiment, the coupling conductor 23*c*E includes the first coupling end portion connected to the base portion of the open stub group 24, and the second coupling end portion connected to the base portion of the open stub group 25.

The coupling conductor 23*c*E of the present embodiment has a stair shape in which the width of the main coupling portion in the X-axis direction changes in a manner that stepwise increases the width as the location of the width changes from the first coupling end portion (portion connected to the base portion of the open stub group 24) toward the strip conductors 23*a* and 23*b* in the impedance adjusting portions 26*a*E and 26*b*E. Further, the coupling conductor 23*c*E has a stair shape in which the width of the main coupling portion in the X-axis direction changes in a manner that stepwise increases the width as the location of the width changes from the second coupling end portion (portion connected to the base portion of the open stub group 25) toward the strip conductors 23*a* and 23*b* in the impedance adjusting portions 26*a*E and 26*b*E.

Because the hollow-waveguide-to-planar-waveguide transition circuit 6 of the present embodiment also includes the open stub groups 24 and 25 as in the first embodiment, a low manufacturing cost and a high operation reliability can be achieved while unnecessary radiation is suppressed. In addition, because the coupling conductor 23*c*E of the present embodiment has the stair shape, a propagation direction of the high-frequency signal incident from the hollow waveguide 40 can be continuously and smoothly changed, so that a traveling direction of the high-frequency signal can be directed to the strip conductors 23*a* and 23*b* sides. As a result, a high-frequency signal can be efficiently propagated to the strip conductors 23*a* and 23*b* while unnecessary radiation is suppressed.

Seventh Embodiment

Figure 11:
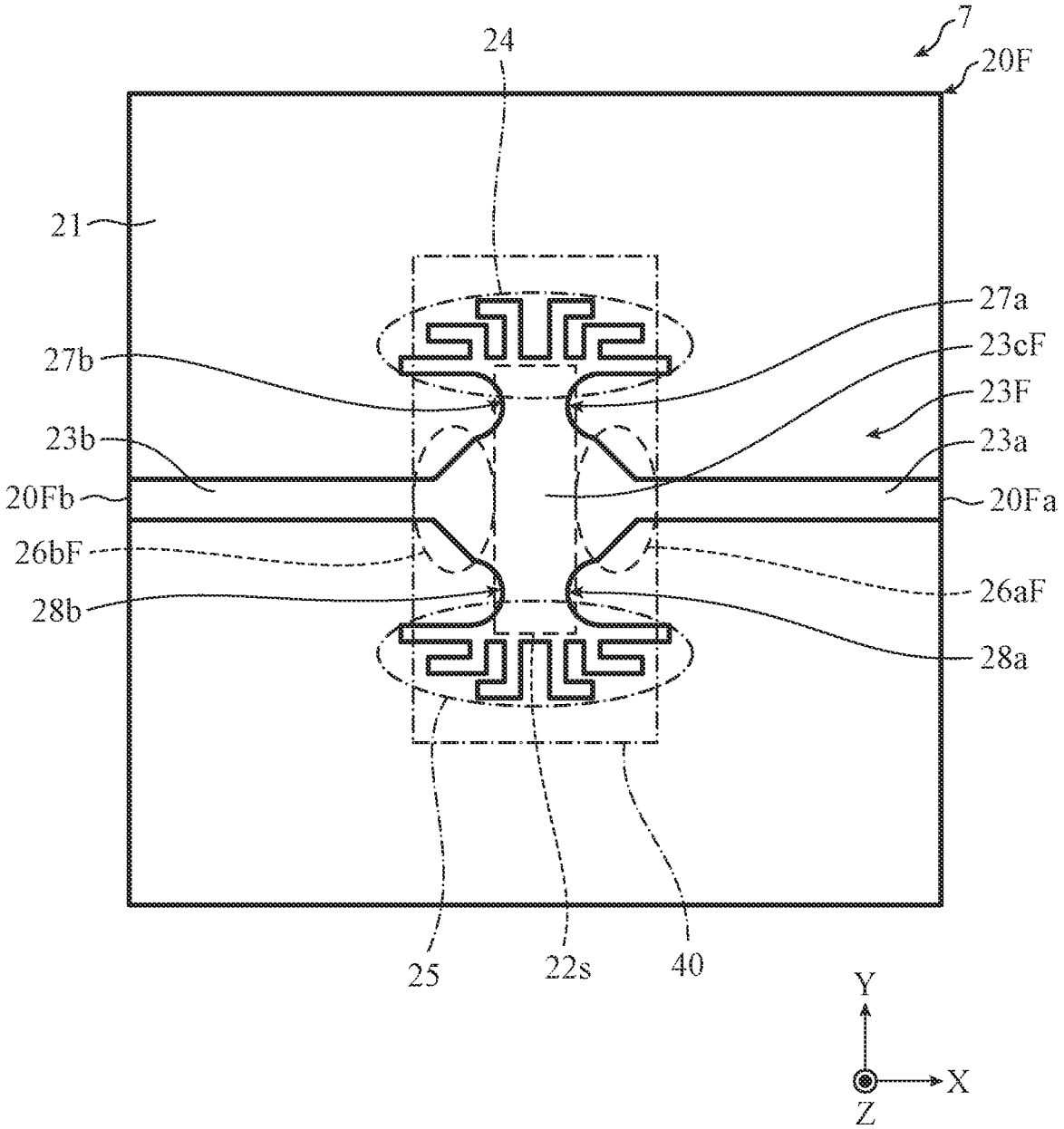
FIG. 11 is a schematic plan view of a hollow-waveguide-to-planar-waveguide transition circuit of a seventh embodiment according to the present invention.

FIG. 11 is a diagram schematically illustrating a planar structure of a hollow-waveguide-to-planar-waveguide transition circuit 7 of the seventh embodiment that is a fourth modification of the first embodiment. The configuration of the hollow-waveguide-to-planar-waveguide transition circuit 7 is the same as that of the hollow-waveguide-to-planar-waveguide transition circuit 1 of the first embodiment except that a conductor pattern 23F of FIG. 11 is included instead of the conductor pattern 23 of FIG. 1. In addition, the step of forming the conductor pattern 23F is the same as the step of forming the conductor pattern 23.

The hollow-waveguide-to-planar-waveguide transition circuit 7 of the present embodiment includes a planar waveguide structure 20F including input/output ends 20Fa and 20Fb as illustrated in FIG. 11, and the planar waveguide structure 20F includes the conductor pattern 23F on the front surface of the dielectric substrate 21. The shape of the conductor pattern 23F is the same as the shape of the conductor pattern 23 of the first embodiment except that a coupling conductor 23*c*F of FIG. 11 is included instead of the coupling conductor 23*c* of FIG. 1.

Similarly to the coupling conductor 23*c*, the coupling conductor 23*c*F of the present embodiment is disposed at a position to face the slot 22*s* provided on the back surface side of the dielectric substrate 21 in the Z-axis direction (thickness direction of the dielectric substrate 21). In addition, as illustrated in FIG. 11, the coupling conductor 23*c*F includes a main coupling portion connected to the inner end portions of the strip conductors 23*a* and 23*b*. Impedance adjusting portions 26*a*F and 26*b*F are formed near both ends of the main coupling portion in the X-axis direction. In addition, as in the first embodiment, the coupling conductor 23*c*F includes the first coupling end portion connected to the base portion of the open stub group 24, and the second coupling end portion connected to the base portion of the open stub group 25.

The coupling conductor 23*c*F of the present embodiment has a tapered shape in which the width of the main coupling portion in the X-axis direction changes in a manner that increases the width as the location of the width changes from the first coupling end portion (portion connected to the base portion of the open stub group 24) toward the strip conductors 23*a* and 23*b* in the impedance adjusting portions 26*a*F and 26*b*F. Further, the coupling conductor 23*c*F has a tapered shape in which the width of the main coupling portion in the X-axis direction changes in a manner that increases the width as the location of the width changes from the second coupling end portion (portion connected to the base portion of the open stub group 25) toward the strip conductors 23*a* and 23*b* in the impedance adjusting portions 26*a*F and 26*b*F.

Because the hollow-waveguide-to-planar-waveguide transition circuit 7 of the present embodiment also includes the open stub groups 24 and 25 as in the first embodiment, a low manufacturing cost and a high operation reliability can be achieved while unnecessary radiation is suppressed. In addition, because the coupling conductor 23*c*F of the present embodiment has the tapered shape, a propagation direction of the high-frequency signal incident from the hollow waveguide 40 can be continuously and smoothly changed, so that a traveling direction of the high-frequency signal can be directed to the strip conductors 23*a* and 23*b* sides. As a result, a high-frequency signal can be efficiently propagated to the strip conductors 23*a* and 23*b* while unnecessary radiation is suppressed.

Eighth Embodiment

In the planar waveguide structure 20 of the first embodiment illustrated in FIG. 1, the slot 22*s* formed on the back surface of the dielectric substrate 21 as illustrated in FIG. 1 has a rectangular shape, although no limitation thereto is intended. The shape of the slot 22*s* may be modified such that the widths (widths in the X-axis direction) of both end portions in the longitudinal direction of the slot 22*s* of the first to third, sixth, and seventh embodiments described above are each greater than the width (width in the X-axis direction) of the midportion of the slot 22*s*. In addition, the shapes of the slots 22*s*1 and 22*s*2 illustrated in FIG. 7 may be modified such that the widths (widths in the X-axis direction) of both end portions in the longitudinal direction of each of the slots 22*s*1 and 22*s*2 of the fourth and fifth embodiments are each greater than the width (width in the X-axis direction) of the midportion of a corresponding one of the slots 22*s*1 and 22*s*2.

Figure 12:
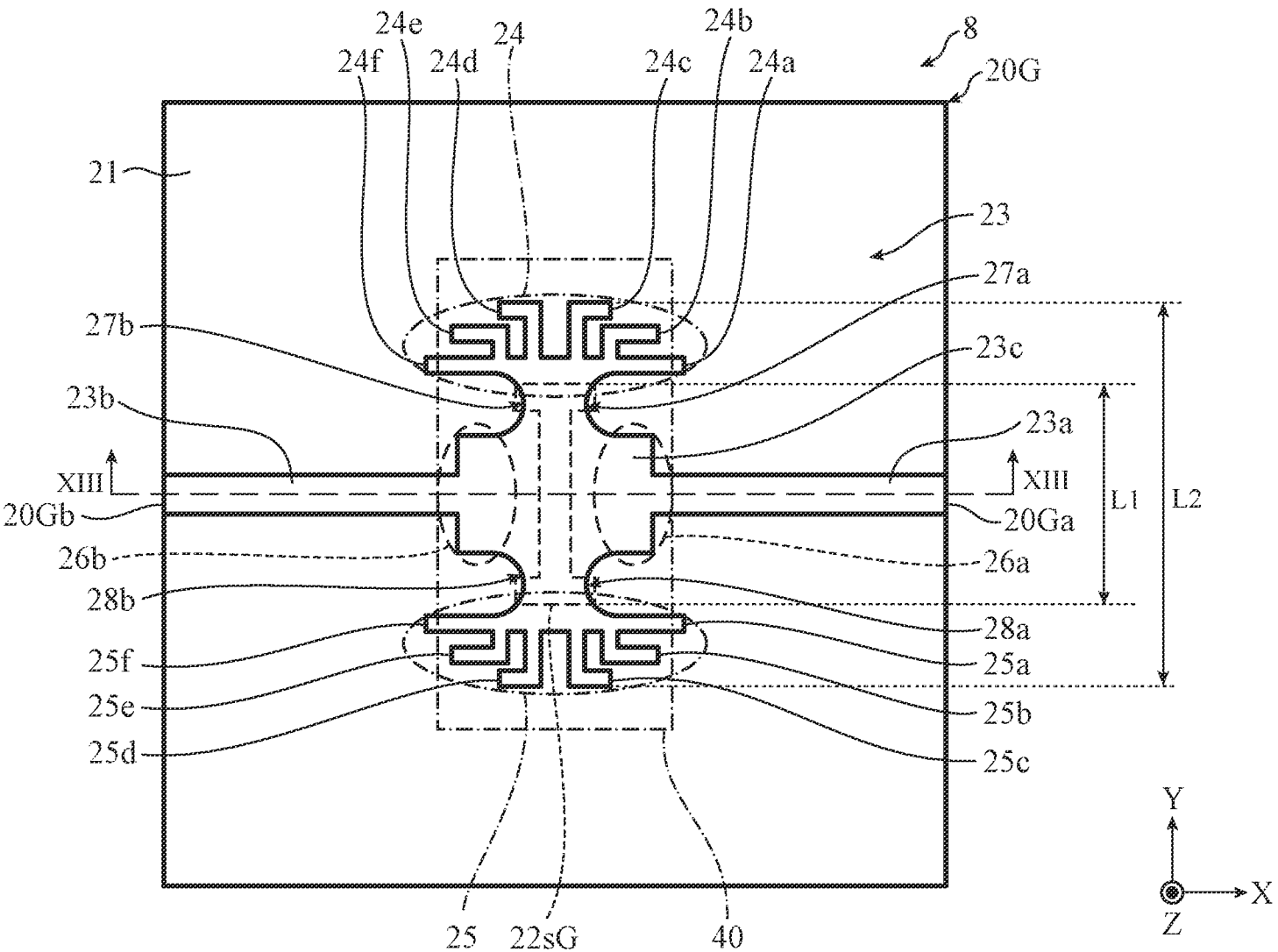
FIG. 12 is a schematic plan view of a hollow-waveguide-to-planar-waveguide transition circuit of an eighth embodiment according to the present invention.
Figure 13:
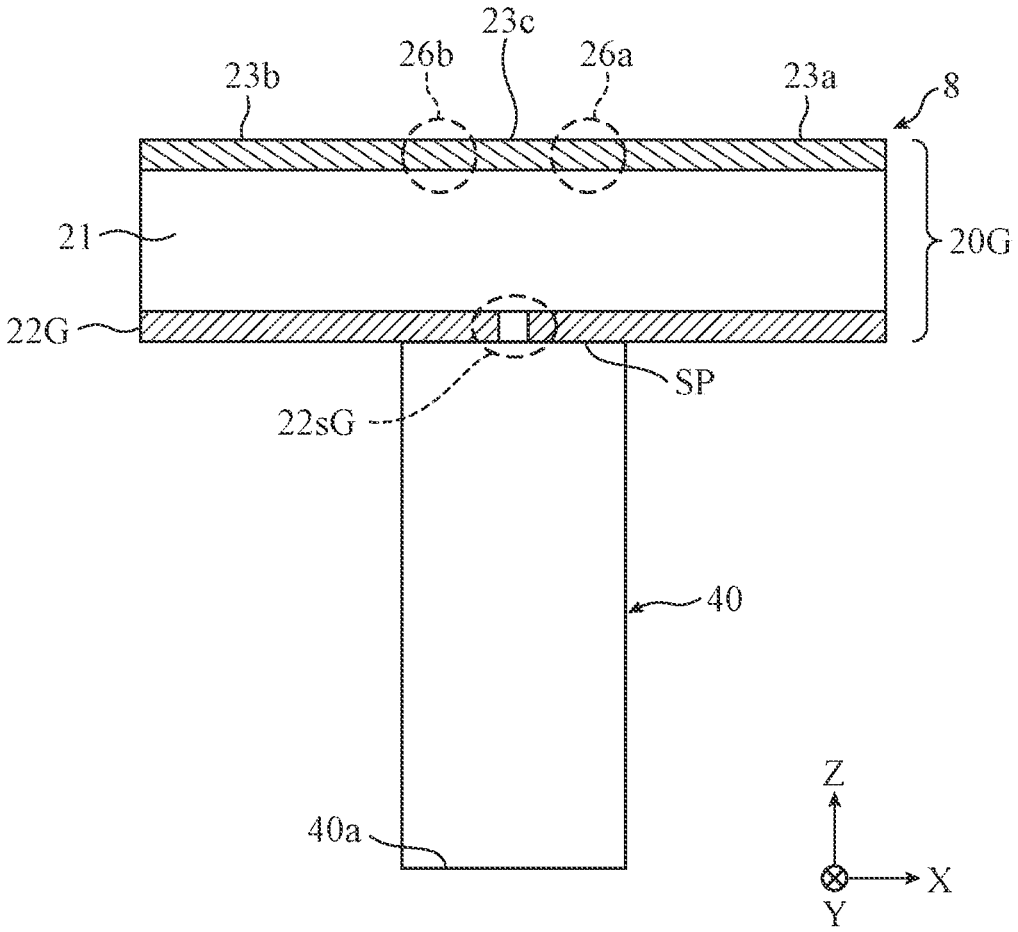
FIG. 13 is a schematic cross-sectional view taken along line XIII-XIII of the hollow-waveguide-to-planar-waveguide transition circuit illustrated in FIG. 12.

FIG. 12 is a diagram schematically illustrating a planar structure of a hollow-waveguide-to-planar-waveguide transition circuit 8 of an eighth embodiment that is a fifth modification of the first embodiment. FIG. 13 is a schematic cross-sectional view taken along line XIII-XIII of the hollow-waveguide-to-planar-waveguide transition circuit 8 illustrated in FIG. 12. The configuration of the hollow-waveguide-to-planar-waveguide transition circuit 8 is the same as that of the hollow-waveguide-to-planar-waveguide transition circuit 1 of the first embodiment except that a slot 22*s*G illustrated in FIGS. 12 and 13 is included instead of the slot 22*s* having the shape illustrated in FIGS. 1 and 2.

The hollow-waveguide-to-planar-waveguide transition circuit 8 of the present embodiment includes a planar waveguide structure 20G including input/output ends 20Ga and 20Gb as illustrated in FIG. 12, and the planar waveguide structure 20G includes the conductor pattern 23 on the front surface of the dielectric substrate 21 as illustrated in FIG. 12, as in the first embodiment. In addition, in the planar waveguide structure 20G, a ground conductor 22G is provided on the back surface of the dielectric substrate 21 as illustrated in FIG. 13. The rectangular slot 22*s*G extending in the Y-axis direction is formed in the ground conductor 22G. As illustrated in FIG. 12, the widths of both end portions of the slot 22*s*G in the longitudinal direction are each greater than the width of the midportion of the slot 22*s*G.

By increasing the widths of the both end portions of the slot 22*s*G in this way, a length L1, illustrated in FIG. 12, in the longitudinal direction (Y-axis direction) of the slot 22*s*G can be reduced (shortened) while the technical effect similar to that of the first embodiment is maintained. As a result, a length L2 of the conductor pattern 23, illustrated in FIG. 12, in the Y-axis direction can be reduced (shortened). Therefore, downsizing of the hollow-waveguide-to-planar-waveguide transition circuit 8 can be achieved.

Note that, the slot 22*s*G as described above can also be applied to a ninth embodiment described below.

Ninth Embodiment

In the first to eighth embodiments depicted in FIGS. 1, 2, and 5-13, the number of input/output ends of each of the planar waveguide structures 20, 20A, 20B, 20C, 20D, 20E, 20F and 20G is two, although no limitation thereto is intended. The planar waveguide structure of each of the above embodiments may be modified to include four or more input/output ends.

Figure 14:
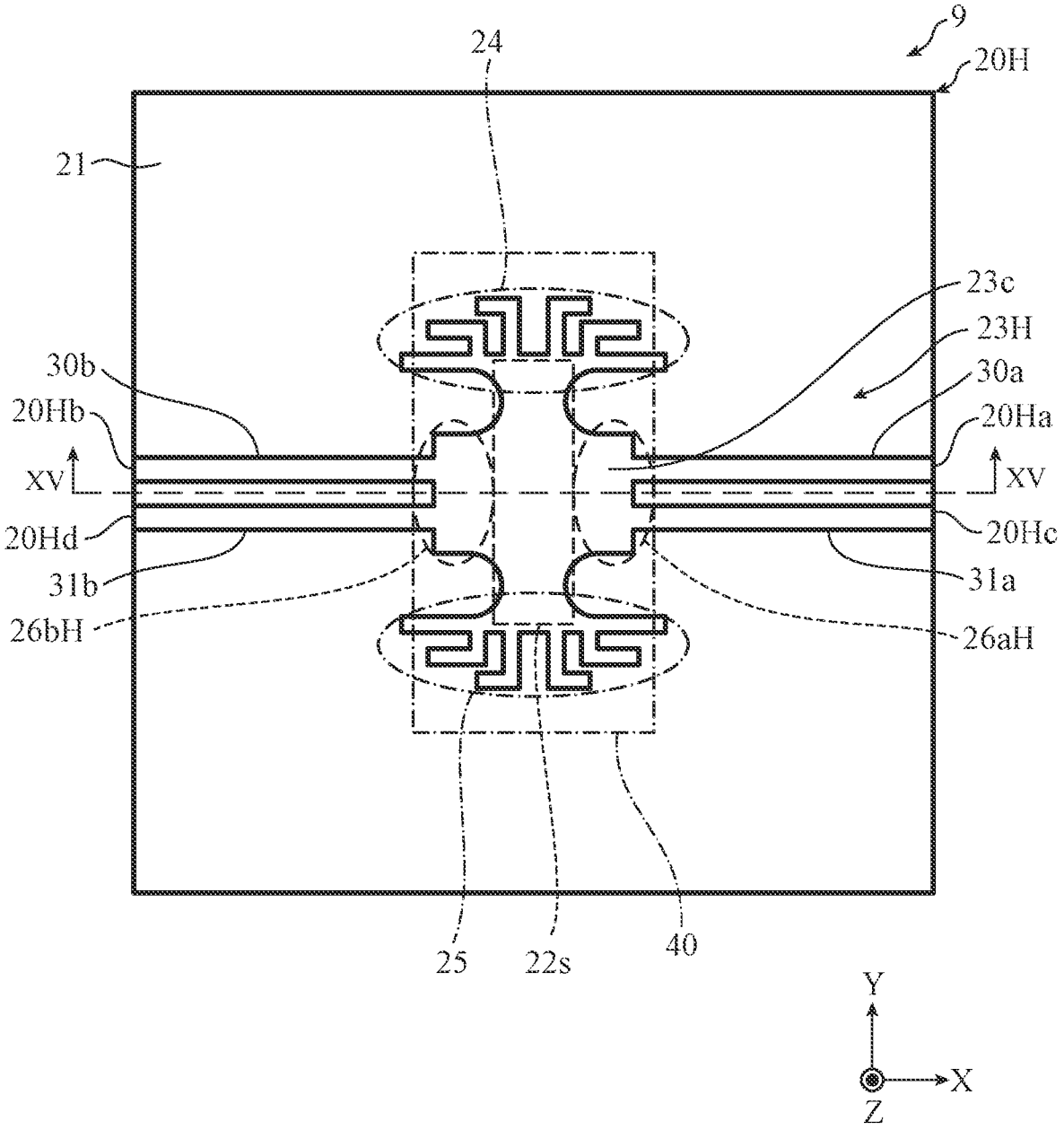
FIG. 14 is a schematic plan view of a hollow-waveguide-to-planar-waveguide transition circuit of a ninth embodiment according to the present invention.
Figure 15:
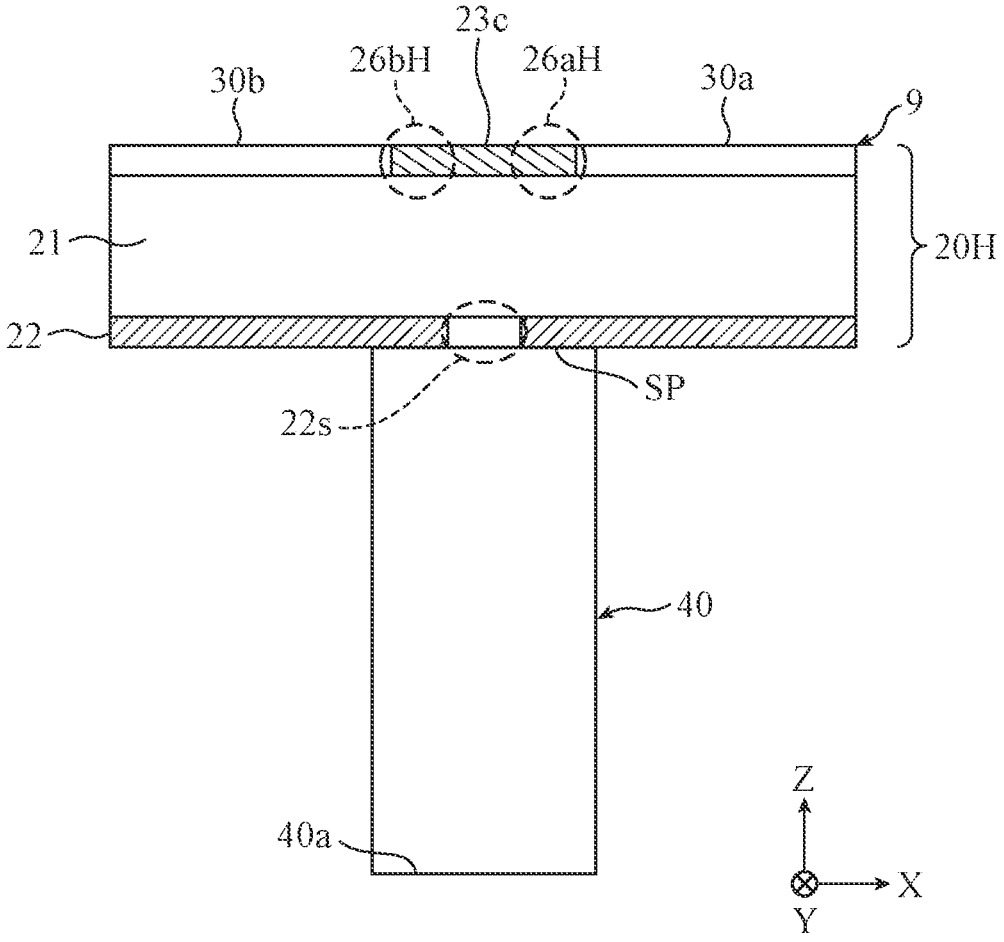
FIG. 15 is a schematic cross-sectional view taken along line XV-XV of the hollow-waveguide-to-planar-waveguide transition circuit illustrated in FIG. 14.

FIG. 14 is a diagram schematically illustrating a planar structure of a hollow-waveguide-to-planar-waveguide transition circuit 9 of the ninth embodiment that is a sixth modification of the first embodiment. FIG. 15 is a schematic cross-sectional view taken along line XV-XV of the hollow-waveguide-to-planar-waveguide transition circuit 9 illustrated in FIG. 14. The configuration of the hollow-waveguide-to-planar-waveguide transition circuit 9 is the same as that of the hollow-waveguide-to-planar-waveguide transition circuit 1 of the first embodiment except that a conductor pattern 23H of FIG. 14 is included instead of the conductor pattern 23 of FIG. 1. In addition, the step of forming the conductor pattern 23H is the same as the step of forming the conductor pattern 23.

The hollow-waveguide-to-planar-waveguide transition circuit 9 of the present embodiment includes a planar waveguide structure 20H including four input/output ends 20Ha, 20Hb, 20Hc, and 20Hd as illustrated in FIG. 14, and the planar waveguide structure 20H includes the conductor pattern 23H on the front surface of the dielectric substrate 21. The conductor pattern 23H includes the coupling conductor 23*c* and the open stub groups 24 and 25 as in the first embodiment. The conductor pattern 23H further includes strip conductors 30*a*, 30*b*, 31*a*, and 31*b* illustrated in FIG. 14, that are linear conductors extending in the X-axis direction. All of the strip conductors 30*a*, 30*b*, 31*a* and 31*b* are connected to the coupling conductor 23*c*.

In addition, the coupling conductor 23*c* of the present embodiment includes a substantially rectangular main coupling portion connected to the inner end portions of the strip conductors 30*a*, 30*b*, 31*a*, and 31*b*, and impedance adjusting portions 26*a*H and 26*b*H illustrated in FIG. 14 are formed near both ends of the main coupling portion in the X-axis direction.

When a high-frequency signal is input to the hollow waveguide 40, the high-frequency signal input excites the slot 22*s*. Because the longitudinal direction (Y-axis direction) of the slot 22*s* intersects the longitudinal direction (extending direction) of the strip conductors 30*a*, 30*b*, 31*a*, and 31*b*, the slot 22*s* excited and the strip conductors 30*a*, 30*b*, 31*a*, and 31*b* are magnetically coupled to each other. Then, the high-frequency signal is output from the input/output ends 20Ha, 20Hb, 20Hc, and 20Hd of the microstrip line via the parallel plate line. As in the case of the first embodiment, the tip portions of the open stubs 24*a*, 24*b*, 24*c*, 24*d*, 24*e*, 24*f*, 25*a*, 25*b*, 25*c*, 25*d*, 25*e* and 25*f* are each in an electrically open state, so that the base portion of each of the open stubs 24*a*, 24*b*, 24*c*, 24*d*, 24*e*, 24*f*, 25*a*, 25*b*, 25*c*, 25*d*, 25*e* and 25*f* is equivalently in an electrical short-circuit state. Therefore, the high-frequency signal is shielded at the connecting portions of the coupling conductor 23*c* with the open stub groups 24 and 25, that is, the first and second coupling end portions. Therefore, unnecessary radiation can be suppressed.

Conversely, when high-frequency signals are each input to the input/output ends 20Ha, 20Hb, 20Hc, and 20Hd of the planar waveguide structure 20H, the high-frequency signals are synthesized and then output from the input/output end 40*a* of the hollow waveguide 40 illustrated in FIG. 15.

As described above, the planar waveguide structure 20H of the ninth embodiment includes the four input/output ends 20Ha, 20Hb, 20Hc, and 20Hd, so that the hollow-waveguide-to-planar-waveguide transition circuit 9 can be achieved also having a function of a multi-distributor.

Although the various embodiments according to the present invention have been described with reference to the drawings, these embodiments are examples of the present invention, and various forms other than these embodiments can be adopted. For example, in the first to ninth embodiments, the number of open stubs 24*a*, 24*b*, 24*c*, 24*d*, 24*e*, 24*f*, 25*a*, 25*b*, 25*c*, 25*d*, 25*e* and 25*f* is twelve The number is not limited to twelve. By reducing the number of open stubs from twelve, the hollow-waveguide-to-planar-waveguide transition circuit can be downsized. In addition, by increasing the number of open stubs to be more than twelve, further improvement can be achieved of the suppression effect of unnecessary radiation, and further improvement can be achieved of the inhibitory effect of the deviation in the distribution characteristic due to the manufacturing error, or the like.

In addition, an open stub group having the same configuration as the open stub groups 24 and 25 may be arranged near the four corners on the front surface of the dielectric substrate 21. As a result, an effect of power loss reduction can be obtained.

Within the scope of the present invention, an arbitrary combination of the first to ninth embodiments, modification of any component of each embodiment, or omission of any component in each embodiment is possible.

INDUSTRIAL APPLICABILITY

Because the hollow-waveguide-to-planar-waveguide transition circuit according to the present invention is used in a high-frequency transmission line for transmitting a high-frequency signal such as a millimeter wave or a microwave, it is suitable for use in an antenna device, radar device and communication device which operate in a high-frequency band such as a millimeter wave band or a microwave band, for example.

REFERENCE SIGNS LIST 1 to 9: Hollow-waveguide-to-planar-waveguide transition circuits; 20, 20A to 20H: Planar waveguide structures; 20*a*, 20*b*: Input/output ends; 21: Dielectric substrate; 22, 22C, 22G: Ground conductors; 22*s*: Slot; 23, 23A, 23B, 23E, 23F, 23H: Conductor patterns; 23*a*, 23*b*: Strip conductors; 23*c*: Coupling conductor; 23*ca*: First coupling conductor; 23*cb*: Connecting portion; 23*cc*: Second coupling conductor; 23*g*, 23*h*: Recessed portions; 24, 25: Open stub groups; 24*a* to 24*f*, 25*a* to 25*f*: Open stubs; 26*a*, 26*b*: Impedance adjusting portions; 27*a*, 27*b*: Notched portions; 30*a*, 30*b*, 31*a*, 31*b*: Strip conductors; 40: Hollow waveguide; 40*a*: Input/output end; and SP: Shorting plane (short-circuit plane).

The invention claimed is:

1. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending along a first in-plane direction determined in advance;

a ground conductor formed on the second main surface to face the one or more strip conductors in the thickness direction;

one or more slots formed in the ground conductor and extending in a second in-plane direction different from the first in-plane direction on the second main surface;

a coupling conductor formed at a position to be electrically coupled with the one or more strip conductors on the first main surface, and disposed at a position facing the one or more slots in the thickness direction; and one or more branch conductor lines branching from an end portion of the coupling conductor in the second in-plane direction on the first main surface, each of the branch conductor lines having a respective base portion branching from the coupling conductor and having a corresponding tip portion that is electrically open, wherein no conductor is provided to connect any of the one or more strip conductors, the coupling conductor, and the one or more branch conductor lines on the first main surface to the ground conductor on the second main surface.

2. The hollow-waveguide-to-planar-waveguide transition circuit according to claim 1, wherein a respective length of each of the one or more branch conductor lines extending from the respective base portion to the corresponding tip portion is equal to a quarter of a wavelength corresponding to a center frequency of a predetermined frequency band for use in the high-frequency signal.

3. The hollow-waveguide-to-planar-waveguide transition circuit according to claim 2, wherein the respective base portion of each of the one or more branch conductor lines is equivalently in an electrical short-circuit state with respect to the center frequency.

4. The hollow-waveguide-to-planar-waveguide transition circuit according to claim 2, wherein a respective width of each of the one or more branch conductor lines is equal to or less than one-tenth of the wavelength.

5. The hollow-waveguide-to-planar-waveguide transition circuit according to claim 1, wherein the one or more branch conductor lines include branch conductor lines that are arranged on the couplings conductor around peripheries at opposite ends of each of the one or more slots in the second-in-place direction of said each of the one or more slots as viewed from the thickness direction.

6. The hollow-waveguide-to-planar-waveguide transition circuit according to claim 1, wherein at least one of the one or more branch conductor lines has a bent shape.

7. The hollow-waveguide-to-planar-waveguide transition circuit according to claim 1, wherein the coupling conductor includes:

a main coupling portion connected to the one or more strip conductors; and a coupling end portion connected to the respective base portion of each of the one or more branch conductor lines, wherein a width of the coupling end portion in the first in-plane direction is narrower than a width of the main coupling portion in the first in-plane direction.

8. The hollow-waveguide-to-planar-waveguide transition circuit according to claim 7, wherein the coupling end portion includes a notched portion to form the width of the coupling end portion.

9. The hollow-waveguide-to-planar-waveguide transition circuit according to claim 8, wherein the coupling conductor has a stair shape in which a width of the main coupling portion extending in the first in-plane direction changes in a tapered manner that stepwise increases the width of the main coupling portion as a location of the width of the coupling conductor extending in the first in-plane direction changes from the coupling end portion toward the one or more strip conductors.

10. The hollow-waveguide-to-planar-waveguide transition circuit according to claim 8, wherein the coupling conductor has a tapered shape in which a width of the main coupling portion extending in the first in-plane direction changes in a manner that increases the width of the main coupling conductor as a location of the width of the coupling conductor extending in the first in-plane direction changes from the coupling end portion toward the one or more strip conductors.

11. The hollow-waveguide-to-planar-waveguide transition circuit according to claim 1, further comprising a hollow waveguide having one end portion connected to a region containing the one or more slots in the ground conductor.

12. The hollow-waveguide-to-planar-waveguide transition circuit according to claim 11, wherein a guide-axis direction of the hollow waveguide and the second main surface are orthogonal to each other.

13. The hollow-waveguide-to-planar-waveguide transition circuit according to claim 1, wherein the coupling conductor is physically connected to the one or more strip conductors.

14. The hollow-waveguide-to-planar-waveguide transition circuit according to claim 1, wherein each of the one or more slots have respective end portions that have corresponding widths which are larger than a width of a corresponding midportion of said each of the one or more slots.

15. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending along a first in-plane direction determined in advance;

a ground conductor formed on the second main surface to face the one or more strip conductors in the thickness direction;

one or more slots formed in the ground conductor and extending in a second in-plane direction different from the first in-plane direction on the second main surface;

a coupling conductor formed at a position to be electrically coupled with the one or more strip conductors on the first main surface, and disposed at a position facing the one or more slots in the thickness direction; and one or more branch conductor lines branching from an end portion of the coupling conductor in the second in-plane direction on the first main surface, each of the branch conductor lines having a respective base portion branching from the coupling conductor and having a corresponding tip portion that is an electrically open, wherein the coupling conductor is disposed physically away from the one or more strip conductors.

16. The hollow-waveguide-to-planar-waveguide transition circuit according to claim 15, wherein:

the one or more strip conductors include a first strip conductor and a second strip conductor which are arranged separately from each other; and the coupling conductor includes a first recessed portion that surrounds an end portion of the first strip conductor facing the coupling conductor, and includes a second recessed portion that surrounds an end portion of the second strip conductor facing the coupling conductor.

* * * * *